US012692566B2

(12) United States Patent
Hyatt et al.

(10) Patent No.: US 12,692,566 B2
(45) Date of Patent: Jul. 28, 2026

(54) TILTING LADLE CARRIER

(71) Applicants: American Hydraulic Services, Inc., Catlettsburg, KY (US); Standard Engineering, LLC, Baton Rouge, LA (US); Edw. C. Levy Co., Detroit, MI (US)

(72) Inventors: Ryan Hyatt, Huntertown, IN (US); Kelly Adams, Tuscaloosa, AL (US); Russell D. Burke, Flat Rock, MI (US); Jeremiah Fulks, Catlettsburg, KY (US); Randall Blankenship, Catlettsburg, KY (US); Adam Deskins, Catlettsburg, KY (US); Jordan Bergeron, Baton Rouge, LA (US); Devin Partin, Baton Rouge, LA (US)

(73) Assignee: Edw. C. Levy Co., Detroit, MI (US)

( * ) Notice: Subject to any disclaimer, the term of this patent is extended or adjusted under 35 U.S.C. 154(b) by 494 days.

(21) Appl. No.: 18/332,126

(22) Filed: Jun. 9, 2023

(65) Prior Publication Data

US 2023/0399711 A1 Dec. 14, 2023

Related U.S. Application Data

(60) Provisional application No. 63/366,207, filed on Jun. 10, 2022.

(51) Int. Cl.
*C21C 5/50* (2006.01)
*C21C 5/46* (2006.01)

(52) U.S. Cl.
CPC ..... *C21C 5/50* (2013.01); *C21C 5/4633* (2013.01)

(58) Field of Classification Search
CPC ..... C21C 5/50; C21C 5/4633
USPC ..... 266/78, 276, 274, 275, 277; 414/586; 164/437
See application file for complete search history.

(56) References Cited

U.S. PATENT DOCUMENTS 5,054,033 A * 10/1991 Wronka ..... F27B 3/19 266/271
5,928,602 A * 7/1999 Linnainmaa ..... C22B 7/001 266/200
8,480,950 B2 * 7/2013 Jetten ..... F27B 7/08 266/248
9,170,050 B2 * 10/2015 Argenta ..... C21C 5/567
10,830,537 B2 * 11/2020 Locatelli ..... C21C 5/527
11,852,414 B2 * 12/2023 Volkert ..... F27D 25/00

* cited by examiner

*Primary Examiner* — Jessee R Roe
*Assistant Examiner* — Michael Aboagye
(74) *Attorney, Agent, or Firm* — Honigman LLP; Andrew J. Boes

(57) ABSTRACT

A carrier for supporting a metallurgical vessel during a cleaning process of the vessel includes a base, a pallet, and a cradle. The base has a longitudinal axis along a length of the base. The pallet is coupled to the base between (i) a first position where a longitudinal axis of the pallet is at a first angle relative to the longitudinal axis of the base, and (ii) a second position where the longitudinal axis of the pallet is at a second angle relative to the longitudinal axis of the base, the second angle greater than the first angle. The cradle is disposed at the pallet and supports the vessel when positioned at the carrier for the cleaning process. Pivoting the pallet between the first position and the second position adjusts an angle of the longitudinal axis of the vessel relative to the longitudinal axis of the base.

20 Claims, 22 Drawing Sheets

TILTING LADLE CARRIER

CROSS REFERENCE TO RELATED APPLICATIONS

This application claims priority under 35 U.S.C. § 119(e) to U.S. Provisional Application 63/366,207 filed on Jun. 10, 2022. The disclosures of these prior applications are considered part of the disclosure of this application and are hereby incorporated by reference in their entireties.

TECHNICAL FIELD

This disclosure relates to a carrier for supporting a metallurgical vessel during a cleaning process of the metallurgical vessel, and more particularly to a tilting carrier for supporting and tilting the metallurgical vessel during the cleaning process.

BACKGROUND

Vessels used in metallurgical and foundry settings, such as steel mills, are used to transport, dispense, and treat molten metals. For example, a vessel may hold molten steel for pouring the molten steel into casting molds, for transporting the molten steel between processes, or for allowing a chemical change to occur to the steel when additives are combined with the molten steel within the vessel. Vessels used in such settings, such as ladles, typically have a hollow cone or bucket-shaped construction, may weigh several hundred tons or more, and have openings with diameters of 15 feet or greater.

Generally, a vessel includes a permanent outer shell and one or more linings, such as refractory linings. Over time, the refractory linings of the vessel may deteriorate and molten metal may solidify and accumulate within the vessel, reducing the capacity of the vessel and introducing impurities to the molten metal. Thus, to extend the life span of the vessel, it is necessary to "clean" the vessel by removing the hardened metal, deteriorated refractory linings, and other waste materials. However, due to the size of the vessels, the heat of the waste materials, and the forces necessary to loosen and remove such materials, these removal and cleaning processes are typically arduous and require use of specialized tools.

SUMMARY

One aspect of the disclosure provides a carrier for supporting a metallurgical vessel during a cleaning process of the metallurgical vessel. The carrier includes a base, a pallet, and a cradle. The base has a longitudinal axis along a length of the base. The pallet is coupled to the base and pivotable between (i) a first position where a longitudinal axis along a length of the pallet is at a first angle relative to the longitudinal axis of the base, and (ii) a second position where the longitudinal axis of the pallet is at a second angle relative to the longitudinal axis of the base. The second angle is greater than the first angle. The cradle is disposed at the pallet and is configured to support the metallurgical vessel when the metallurgical vessel is positioned at the carrier for the cleaning process. Pivoting the pallet between the first position and the second position adjusts an angle of a longitudinal axis of the metallurgical vessel relative to the longitudinal axis of the base.

Implementations of the disclosure may include one or more of the following optional features. In some implementations, the pallet is pivotable between the first position and the second position via operation of a tilting mechanism. In further implementations, the tilting mechanism includes a hydraulic system disposed at the carrier. The hydraulic system is operable to pivot the pallet between the first position and the second position responsive to a user input at a control of the hydraulic system. In even further implementations, the control of the hydraulic system is remote from the carrier and in wireless communication with the carrier for operation of the hydraulic system.

In some embodiments, the longitudinal axis of the base is parallel to a ground surface at which the carrier is disposed. In some examples, the longitudinal axis of the pallet is parallel to the longitudinal axis of the base when the pallet is in the first position.

In some implementations, the second angle is at least 10 degrees greater than the first angle. In some embodiments, the longitudinal axis of the metallurgical vessel is parallel to the longitudinal axis of the pallet when the metallurgical vessel is positioned at the carrier.

In some examples, the cradle engages an outer surface of the metallurgical vessel to support the metallurgical vessel at the carrier. In further examples, the cradle includes (i) a first support configured to engage the outer surface of the metallurgical vessel at a first axial position and defines a first radius of curvature corresponding to a first diameter of the metallurgical vessel at the first axial position, and (ii) a second support configured to engage the outer surface of the metallurgical vessel at a second axial position and defines a second radius of curvature corresponding to a second diameter of the metallurgical vessel at the second axial position.

In other further examples, the cradle includes a first anti-rotation support along a first side of the pallet that prevents the metallurgical vessel from rotating in a first direction when the metallurgical vessel is positioned at the carrier and engages the first anti-rotation support.

In some implementations, a series of flanges disposed along a first edge of the pallet are pivotally coupled to adjacent corresponding flanges disposed along an upper surface of the base to pivotally attach the pallet to the base. In some embodiments, the base includes (i) a raised platform having a length that defines the longitudinal axis of the base, (ii) a first support structure extending along a first edge region of the raised platform and parallel to the longitudinal axis of the base, and (iii) a second support structure extending along a second edge region of the raised platform opposite the first edge region and parallel to the longitudinal axis of the base. In further embodiments, a respective runner is disposed along a length of each of the first support structure and the second support structure.

In some examples, the carrier is positioned proximal to a receptacle so that, when the longitudinal axis of the metallurgical vessel is adjusted, material within the metallurgical vessel may fall to the receptacle.

Another aspect of the disclosure provides a carrier for supporting a metallurgical vessel during a cleaning process of the metallurgical vessel. The carrier includes a base, a pallet, a tilting mechanism, and a cradle. The base includes (i) a raised platform having a length that defines a longitudinal axis of the base, (ii) a first support structure extending along a first edge region of the raised platform and parallel to the longitudinal axis of the base, and (iii) a second support structure extending along a second edge region of the raised platform opposite the first edge region and parallel to the longitudinal axis of the base. The pallet is pivotally disposed at the base and pivotable between (i) a first position where a longitudinal axis along a length of the pallet is at a first angle relative to the longitudinal axis of the base, and (ii) a second position where the longitudinal axis of the pallet is at a second angle relative to the longitudinal axis of the base, the second angle greater than the first angle. The tilting mechanism is disposed at the carrier and operable to pivot the pallet between the first position and the second position responsive to a user input at a control of the tilting mechanism. The cradle is disposed at the pallet and configured to support the metallurgical vessel when the metallurgical vessel is positioned at the carrier for the cleaning process. Pivoting the pallet between the first position and the second position adjusts an angle of a longitudinal axis of the metallurgical vessel relative to the longitudinal axis of the base. This aspect may include one or more of the following optional features.

In some implementations, the tilting mechanism includes a hydraulic system disposed at the carrier. In some embodiments, the control of the tilting mechanism is remote from the carrier and in wireless communication with the carrier for operation of the tilting mechanism. In some examples, the longitudinal axis of the base is parallel to a ground surface at which the carrier is disposed.

In some implementations, the longitudinal axis of the pallet is parallel to the longitudinal axis of the base when the pallet is in the first position. In some embodiments, the second angle is at least 10 degrees greater than the first angle. In some examples, the cradle is configured to align the longitudinal axis of the metallurgical vessel parallel to the longitudinal axis of the pallet when the metallurgical vessel is positioned at the carrier.

In some implementations, the cradle is configured to engage an outer surface of the metallurgical vessel to support the metallurgical vessel at the carrier. In further implementations, the cradle includes (i) a first support configured to engage the outer surface of the metallurgical vessel at a first axial position and that defines a first radius of curvature corresponding to a first diameter of the metallurgical vessel at the first axial position, and (ii) a second support configured to engage the outer surface of the metallurgical vessel at a second axial position and that defines a second radius of curvature corresponding to a second diameter of the metallurgical vessel at the second axial position.

In other further implementations, the cradle includes a first anti-rotation support along a side portion of the pallet that prevents the metallurgical vessel from rotating in a first direction when the metallurgical vessel is positioned at the carrier and engages the first anti-rotation support.

In some embodiments, a series of flanges disposed along a first edge of the pallet are pivotally coupled to adjacent corresponding flanges disposed along an upper surface of the base to pivotally attach the pallet to the base. In some examples, a respective runner is disposed along a length of each of the first support structure and the second support structure. In some implementations, the carrier is positioned proximal to a receptacle so that, when the longitudinal axis of the metallurgical vessel is adjusted, material within the metallurgical vessel may fall to the receptacle.

Yet another aspect of the present disclosure provides a method for removing waste material from a metallurgical vessel during a cleaning process of the metallurgical vessel. The method includes positioning a metallurgical vessel at a tiltable carrier. The tiltable carrier includes a base, a pallet, and a cradle. The base has a longitudinal axis along a length of the base. The pallet is pivotally disposed at the base and pivotable between (i) a first position where a longitudinal axis along a length of the pallet is at a first angle relative to the longitudinal axis of the base, and (ii) a second position where the longitudinal axis of the pallet is at a second angle relative to the longitudinal axis of the base. The second angle is greater than the first angle. The cradle is disposed at the pallet and configured to support the metallurgical vessel when the metallurgical vessel is positioned at the tiltable carrier. With the metallurgical vessel positioned at the tiltable carrier and with the pallet in the first position, the method includes loosening waste material from an interior surface of the metallurgical vessel. After loosening waste material from the interior surface of the metallurgical vessel, the method includes pivoting the pallet to the second position to dispense loosened waste material from the metallurgical vessel. Pivoting the pallet between the first position and the second position adjusts an angle of a longitudinal axis of the metallurgical vessel relative to the longitudinal axis of the base. This aspect may include one or more of the following optional features.

In some implementations, the pallet is pivotable between the first position and the second position via operation of a hydraulic system disposed at the carrier. The hydraulic system is operable to pivot the pallet between the first position and the second position responsive to a user input at a control of the hydraulic system. In some embodiments, the tiltable carrier is positioned proximal to a receptacle so that, while dispensing the loosened waste material from the metallurgical vessel, the waste material may fall to the receptacle. In further embodiments, the receptacle includes a conveyor or a hopper and the method includes operating the conveyor or the hopper to move fallen waste material away from the tiltable carrier.

In some examples, the second angle is at least 10 degrees greater than the first angle. Optionally, the method may include, while loosening waste material from the interior surface of the metallurgical vessel, pivoting the pallet between the first position and the second position to adjust the angle of the longitudinal axis of the metallurgical vessel to improve accessibility to the interior surface of the metallurgical vessel.

The details of one or more implementations of the disclosure are set forth in the accompanying drawings and the description below. Other aspects, features, and advantages will be apparent from the description and drawings, and from the claims.

DESCRIPTION OF DRAWINGS

The drawings described herein are for illustrative purposes only of selected configurations and not all possible implementations, and are not intended to limit the scope of the present disclosure.

Like reference symbols in the various drawings indicate like elements.

DETAILED DESCRIPTION

Figure 1:
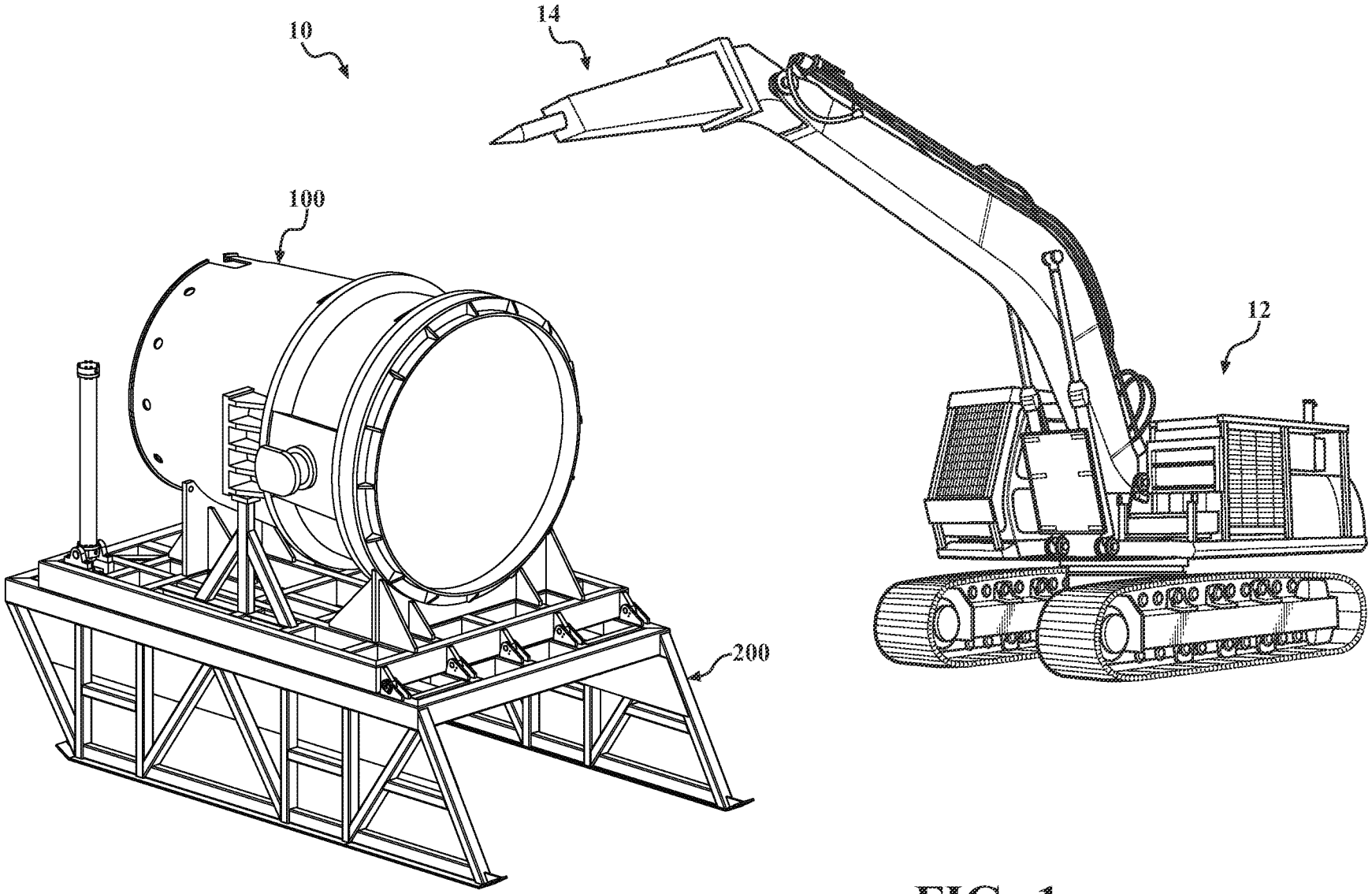
FIG. 1 is an environmental view of a carrier supporting a metallurgical vessel during an example cleaning process of the vessel, during which an operator may loosen and remove waste material from the vessel using a boom attachment and an excavator.

Large metallurgical vessels, such as ladles, used in industrial or foundry or production facilities, such as steel mills, must undergo cleaning processes to remove hardened metal, deteriorated refractory linings, and other waste materials. Such removal and cleaning processes often require time-consuming procedures where the vessel is held in a stationary position so that an operator may use specialized equipment to reach into the interior of the vessel to loosen the waste materials. For example, and as shown in FIG. 1, the industrial or foundry environment 10 may include an excavator 12 with a boom attachment 14 (such as a hydraulic hammer, ram, chisel, jackhammer, or the like) that may be used to reach into a vessel 100 to apply forces to loosen the waste material. These processes require the vessel 100 to be removed from service within the environment 10, either by physically moving the vessel 100 to a dedicated cleaning location, or by pausing operational activities and cleaning the vessel 100 in its working area. After the waste materials are loosened, they are removed from the vessel 100 and the vessel 100 may be returned to service.

Due to the size of the vessel 100 used in such industrial environments 10 and the magnitude of the forces necessary to loosen the waste materials, the vessel 100 is typically cleaned in a stationary position, and usually at or near ground level, which can make it difficult to manipulate the vessel 100 and/or cleaning tools (i.e., the excavator 12 and boom attachment 14) for accessing the interior of the vessel 100 and for removal of the loosened material from the vessel 100. Further, such processes are generally undertaken before the vessel 100 and waste materials have fully cooled from the associated metallurgical processes, so that the waste metal and refractory linings may be more pliable and easier to remove, which makes it dangerous for human operators to access the interior of the vessel 100 to loosen hard-to-reach materials and remove loosened material from the vessel 100. Additionally, if the vessel 100 is removed from its working area (where, for example, the vessel 100 may be suspended from an overhead crane, disposed on a rail car, etc.) within the environment 10 to a dedicated cleaning location, movement before and after the cleaning process generally requires additional, costly equipment that may be difficult to maneuver around the environment 10. If the vessel 100 is not removed from its working area to undergo cleaning processes, time spent loosening and removing waste materials drastically affects the production efficiencies of the facility.

Thus, it is an aspect of the present disclosure to provide a carrier 200 for supporting a metallurgical vessel 100 during a cleaning process of the metallurgical vessel 100 where the carrier 200 provides a tilting function and, optionally, a mobility feature to improve mobility of the vessel 100 within the facility environment 10. The tilting function allows for improved access to the interior of the vessel 100 and easier removal of loosened material from the vessel 100. For example, titling the vessel 100 during the cleaning process may provide improved accessibility for cleaning tools to the interior of the vessel 100. Tilting the vessel 100 after loosening of waste material may allow for the waste material to be dumped from the vessel 100 rather than removed through use of cleaning tools. Therefore, the carrier 200 increases the production efficiency of operations at the facility.

As described further below, the carrier 200 includes a support structure or base 300 and a tilting structure or pallet 400 disposed atop the base 300, with a mounting structure or cradle 500 mounted to the pallet 400. The cradle 500 is configured to receive the vessel 100 when the vessel 100 is positioned at the carrier 200 to undergo the cleaning process and secure or maintain a position of the vessel 100 at the carrier 200. During the cleaning process, the carrier 200 supports the vessel 100 in a substantially horizontal position so that an opening of the vessel 100 is substantially perpendicular to the ground surface. Thus, standard cleaning tools (such as the excavator 12 with boom attachment 14) and processes may be used to remove waste materials from the vessel 100 while the carrier 200 supports the vessel 100 in the horizontal position. The base 300 elevates the pallet 400 and cradle 500 above the ground surface for improved access to the interior of the vessel 100. Furthermore, the base 300, pallet 400, and cradle 500 are collectively configured to support the weight and size of any large, industrial ladle or vessel and withstand the substantial forces that may be applied to the vessel 100 and waste material during the cleaning process.

During and/or after the cleaning process, the pallet 400 may be tilted relative to the base 300 and ground surface. Tilting the vessel 100 provides easier access to the interior of the vessel 100 for the cleaning tools, increased visibility to the interior of the vessel 100 for the operator of the cleaning tools, and allows for easier removal of loosened material from the vessel 100. For example, after the operator loosens material from the interior surface of the vessel 100, the pallet 400 and vessel 100 may be tilted relative to the base 300 to dump loosened material from the vessel 100. Movement of the pallet 400 may be accomplished by a tilting mechanism 600, such as a hydraulic lift system, incorporated into the carrier 200 and operated by controls at the carrier 200 or remote from the carrier 200 and in communication with the tilting mechanism 600. Thus, the present disclosure provides a carrier 200 configured to receive any suitable metallurgical vessel or ladle to support the vessel 100 during cleaning processes and to provide a tilting feature of the vessel 100 during and/or after such cleaning processes, improving safety and efficiency.

Figure 2:
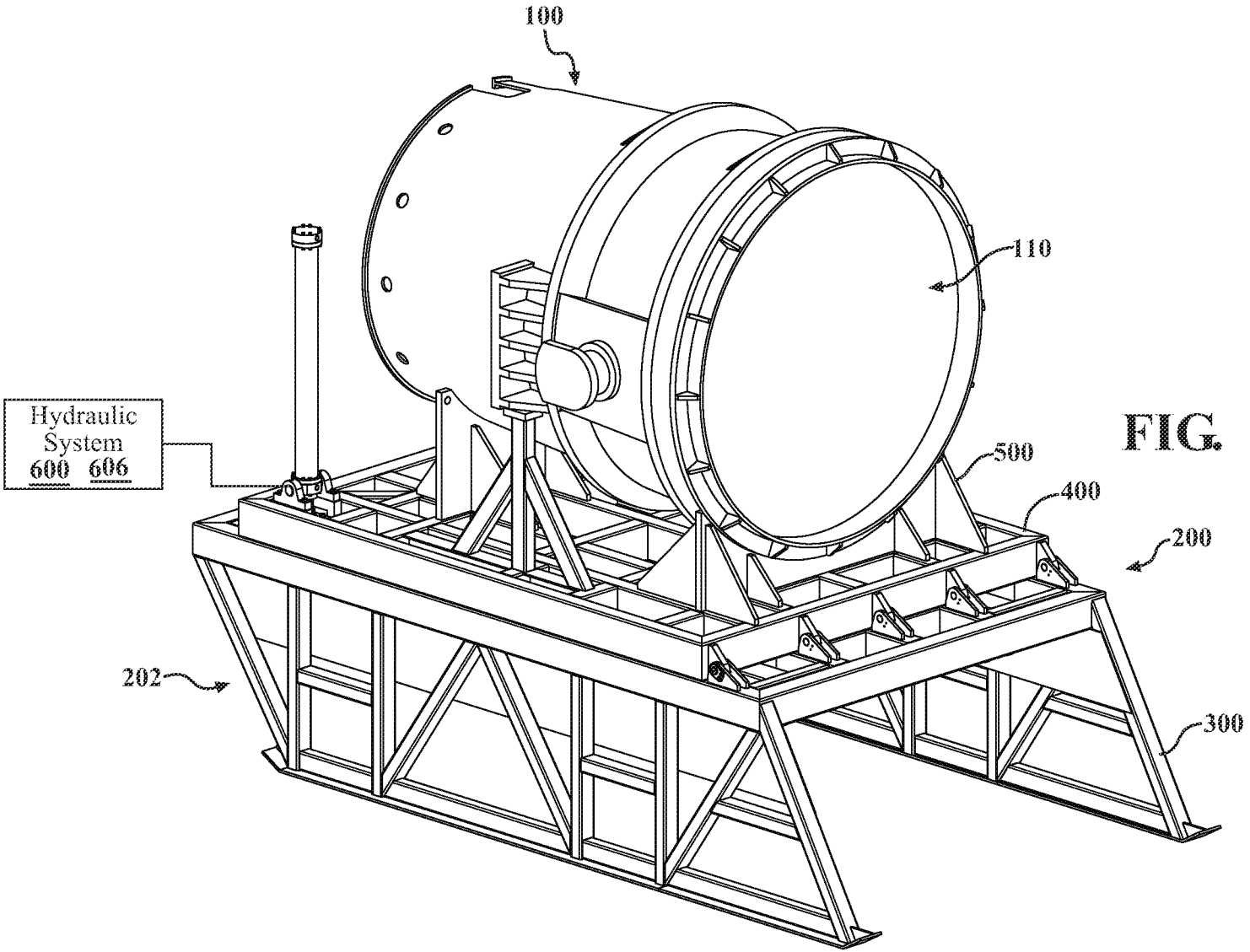
FIGS. 2 and 3 are views of the carrier and vessel of FIG. 1 where the carrier is in a first or resting position.
Figure 3:
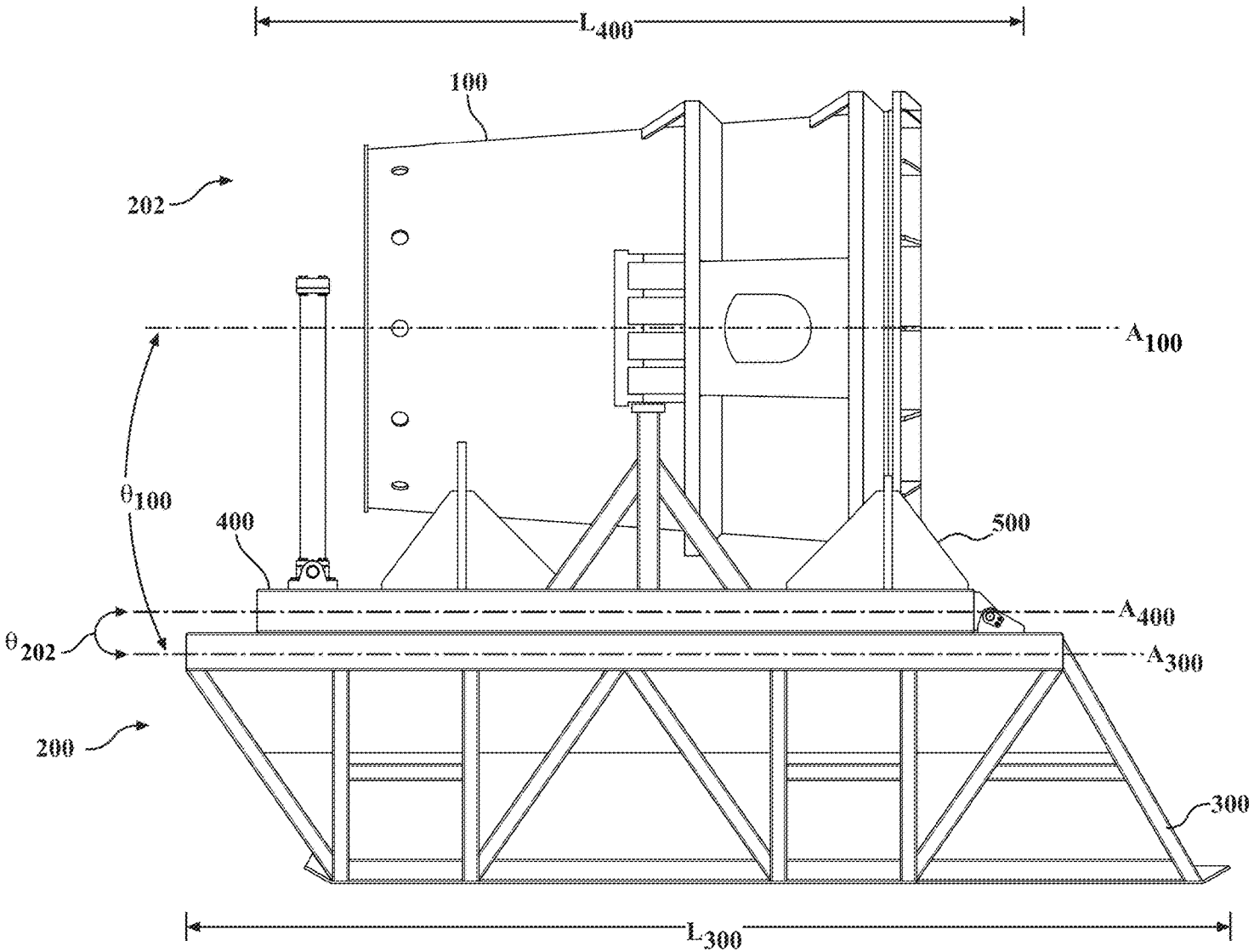
Figure 4:
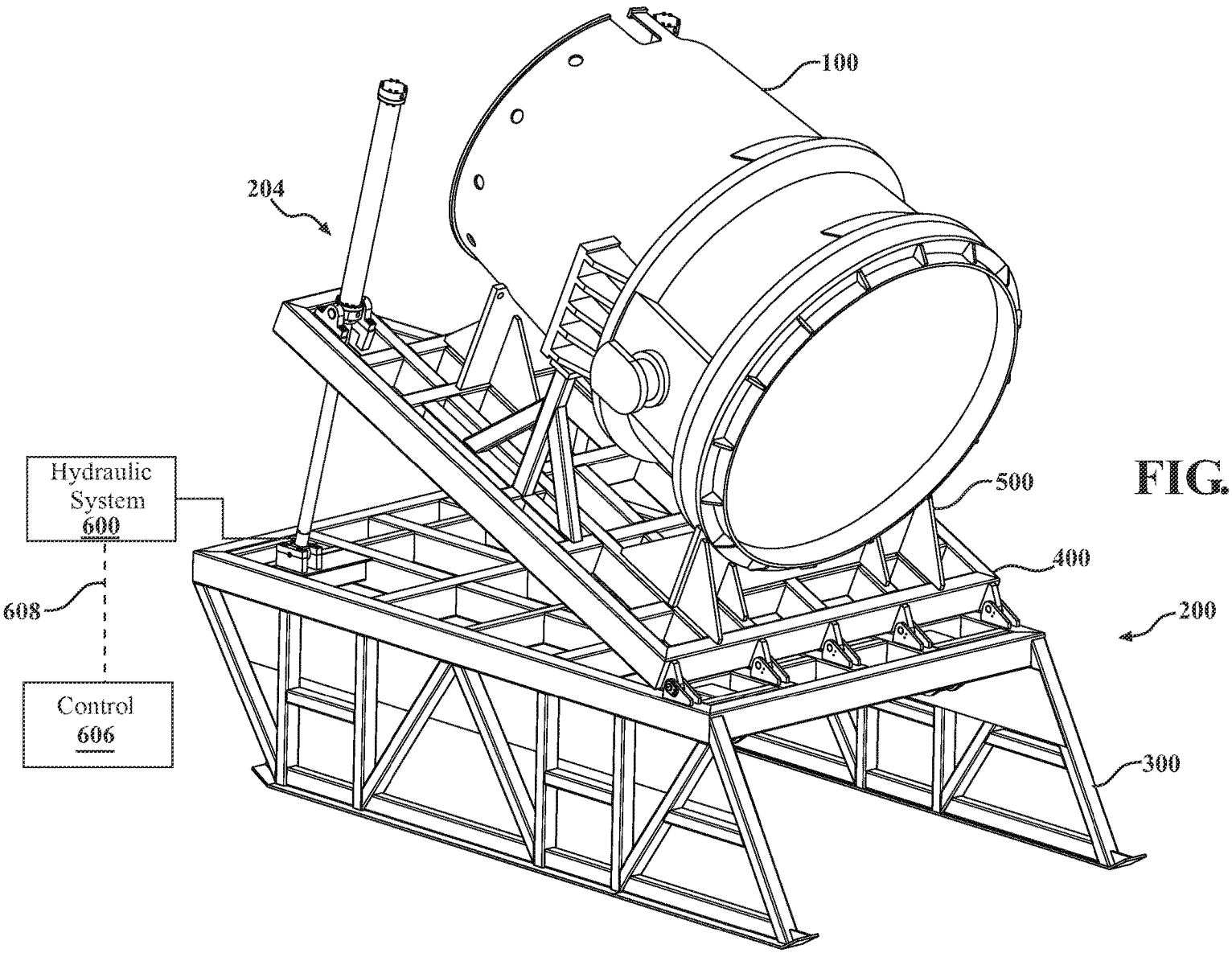
FIGS. 4 and 5 are views of the carrier and vessel of FIG. 1 where the carrier is in a second or tilting position.
Figure 5:
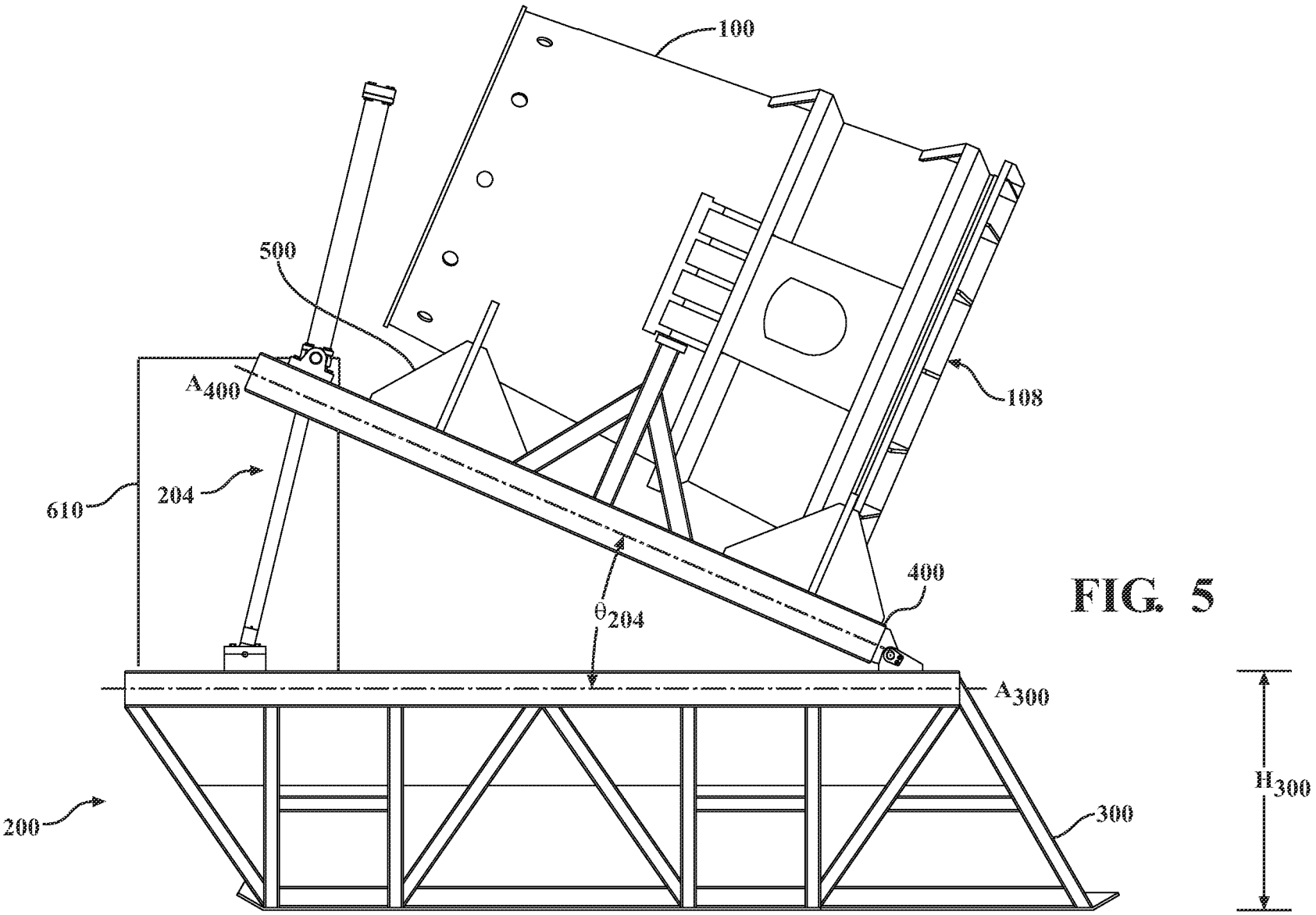

As shown in FIGS. 2-5, in some implementations, a carrier 200 for supporting a metallurgical vessel 100 during a cleaning process of the vessel 100 includes the base 300, the pallet 400, and the cradle 500. The pallet 400 is pivotally disposed atop the base 300 and is pivotable between a first position 202 (FIGS. 2 and 3) and a second position 204 (FIGS. 4 and 5). Movement of the pallet 400 relative to the base 300 may be accomplished via operation of a tilting mechanism 600, such as a hydraulic lift system (FIGS. 2 and 4). The cradle 500 is disposed at the pallet 400 and is configured to support the vessel 100 at the carrier 200 for the cleaning process. When the carrier 200 is in the first or retracted or resting position 202, the pallet 400 is at a first angle $\theta_{202}$ relative to the base 300 (FIG. 3). When the carrier 200 is in the second or extended or tilting or dumping position 204, the pallet 400 is at a second angle $\theta_{204}$ relative to the base 300 (FIG. 5), where the second angle $\theta_{204}$ is greater than the first angle $\theta_{202}$. Thus, pivoting the pallet 400 between the first position 202 and the second position 204 adjusts an angle $\theta_{100}$ of the vessel 100 relative to the base 300.

Adjusting the angle $\theta_{100}$ of the vessel 100 during and/or after the cleaning processes provides for easier access to the interior cavity of the vessel 100 for loosening of waste material and for dumping of loosened waste material. Due to the size and weight of metallurgical vessels and magnitude of the forces necessary to loosen waste materials, typical systems for supporting the vessel during the cleaning process do not offer a tilting function. While the vessel 100 may be cleaned in its working area (e.g., supported by an overhead crane, disposed on a rail car, etc.) to utilize the tilting functions of such locations, this greatly reduces the efficiencies of the production environment as the vessel 100 cannot be replaced by a previously cleaned vessel at the working area.

Figure 6:
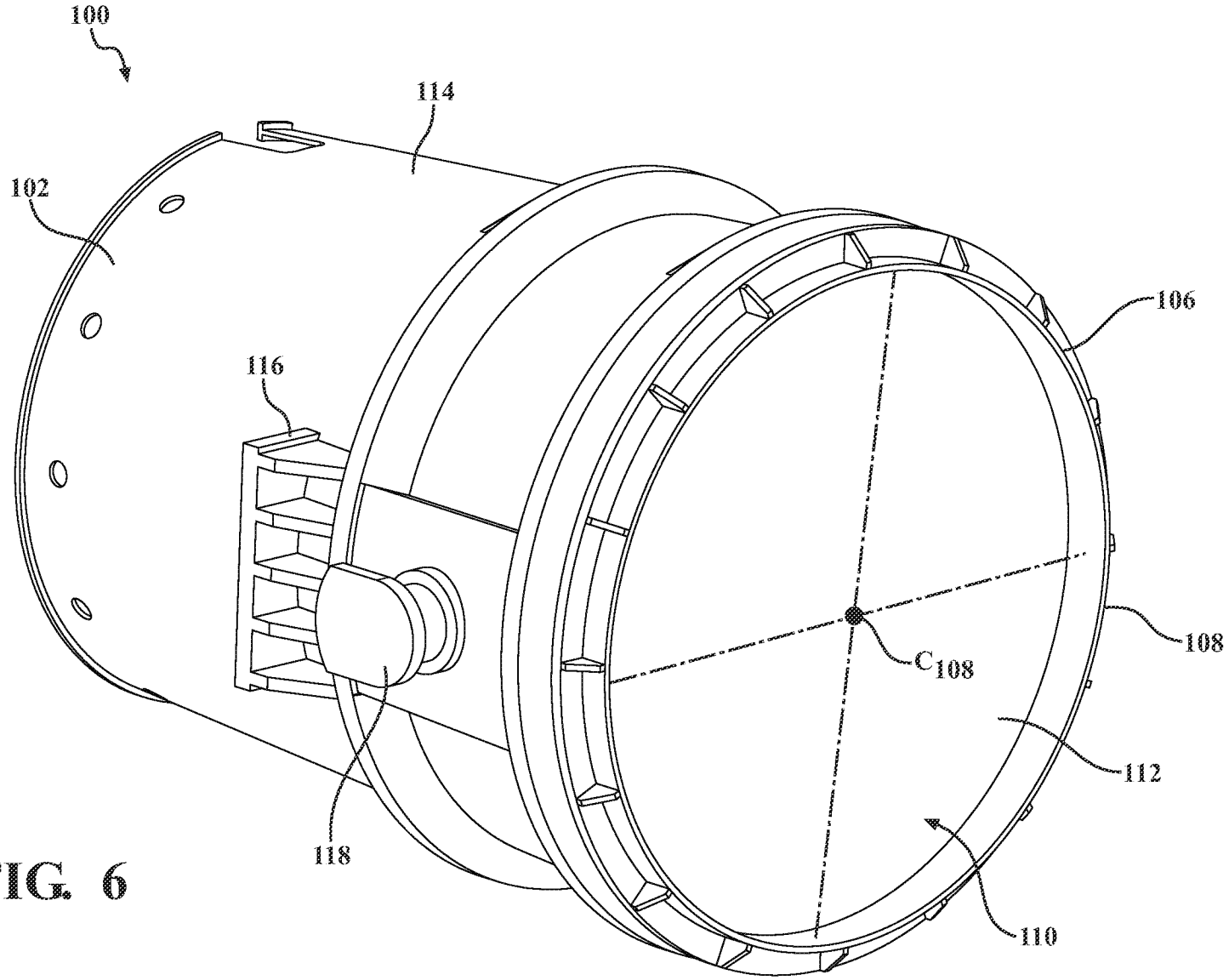
FIGS. 6-8 are views of an example metallurgical vessel suitable to be supported at the carrier.
Figure 7:
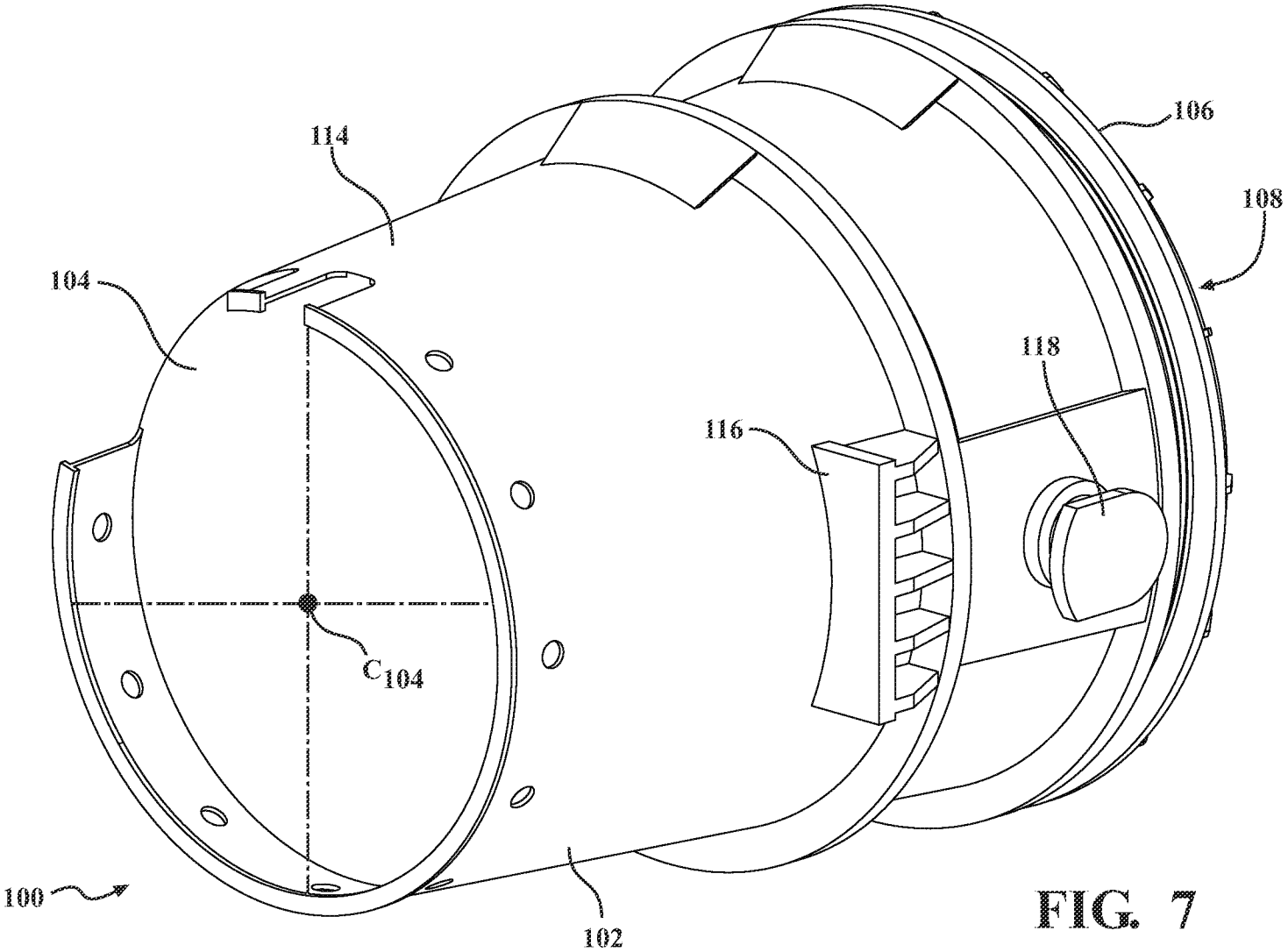
Figure 8:
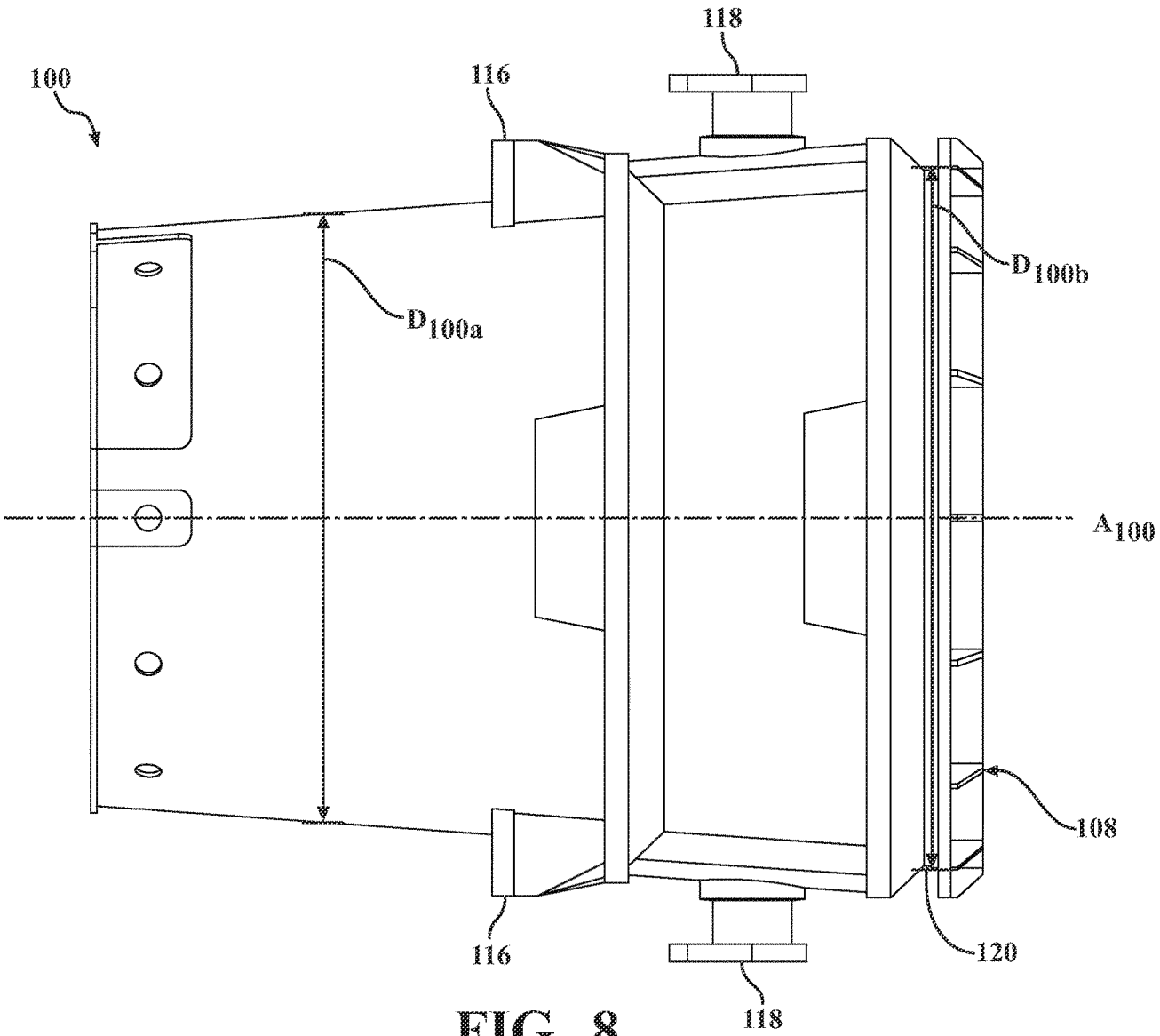
Figure 9:
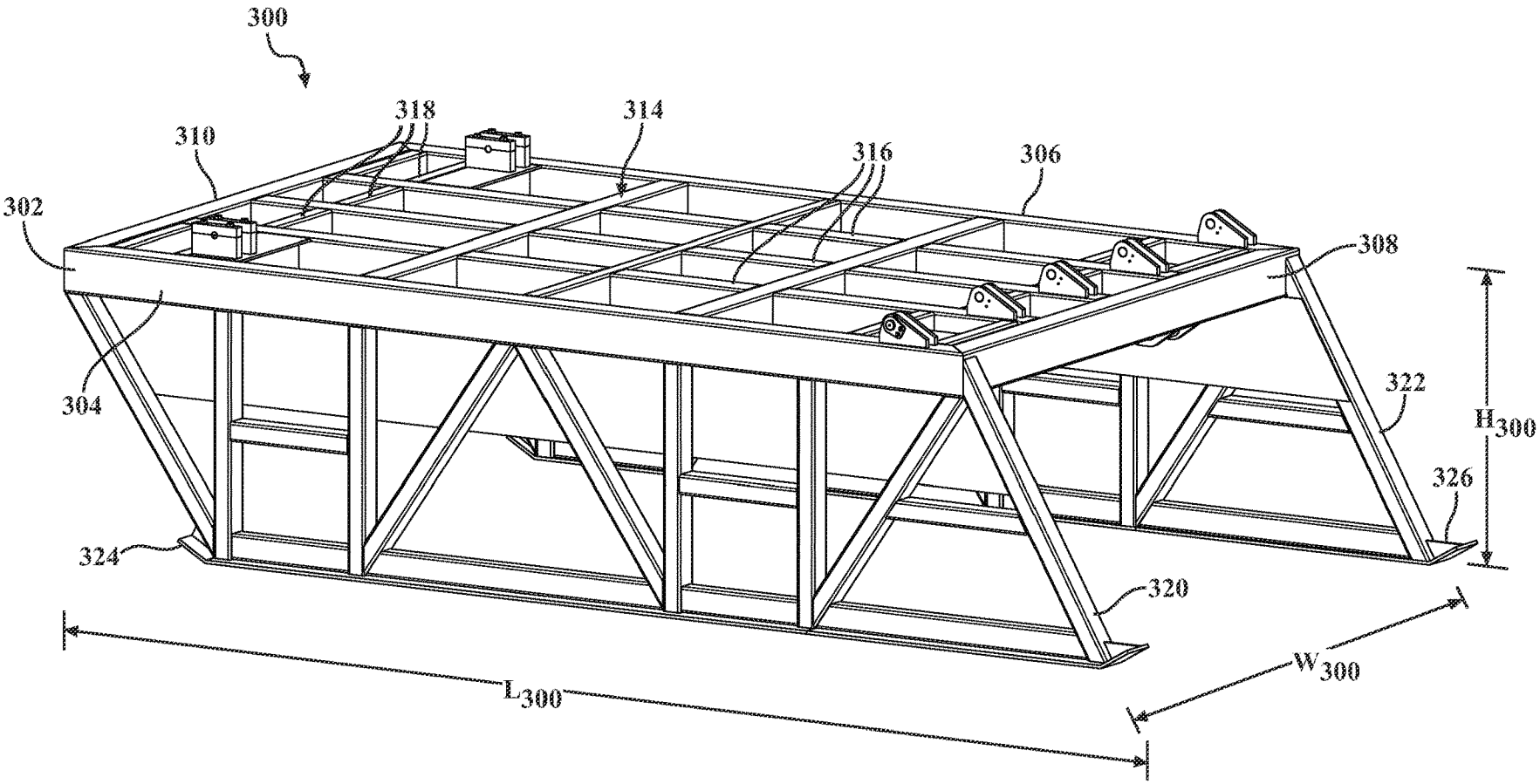
FIGS. 9-12 are views of a base of the carrier with the pallet, cradle, and tilting mechanism removed.
Figure 10:
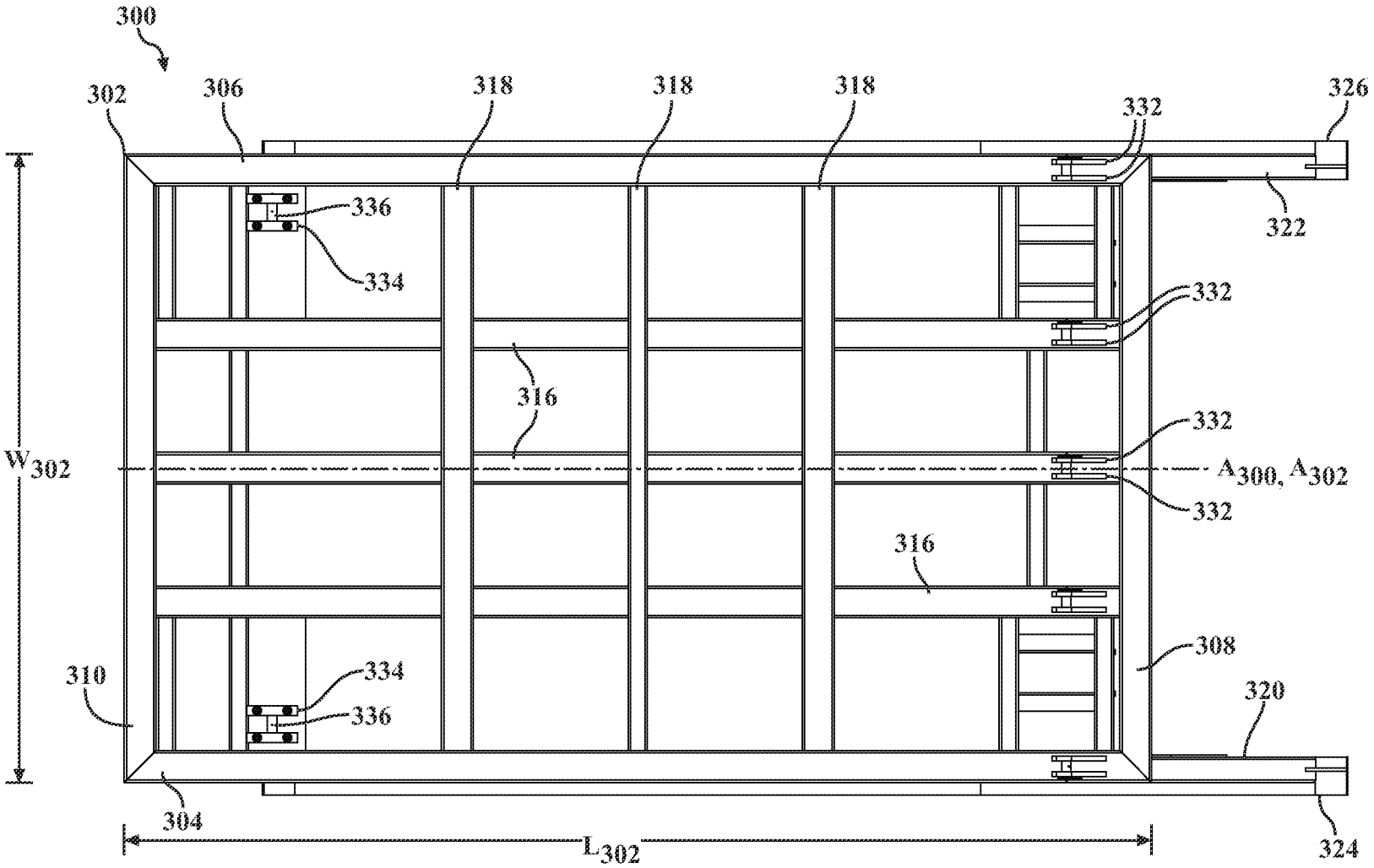
Figure 11:
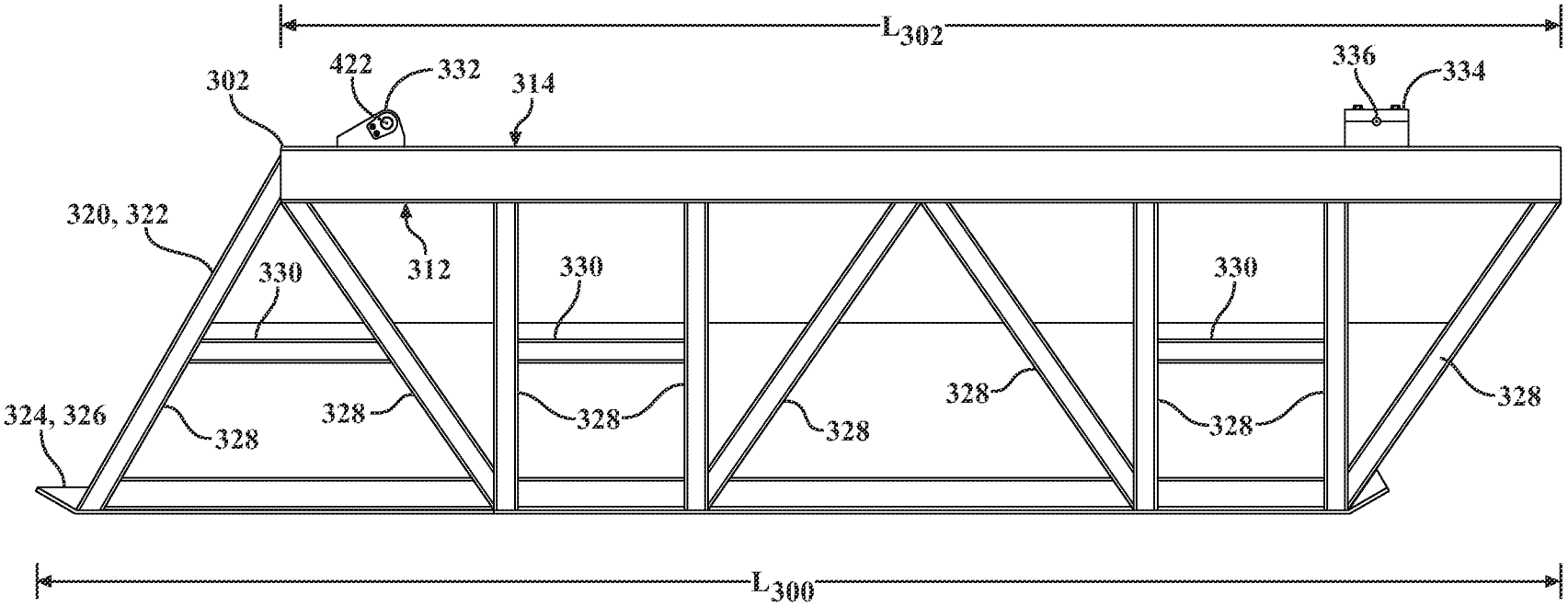
Figure 12:
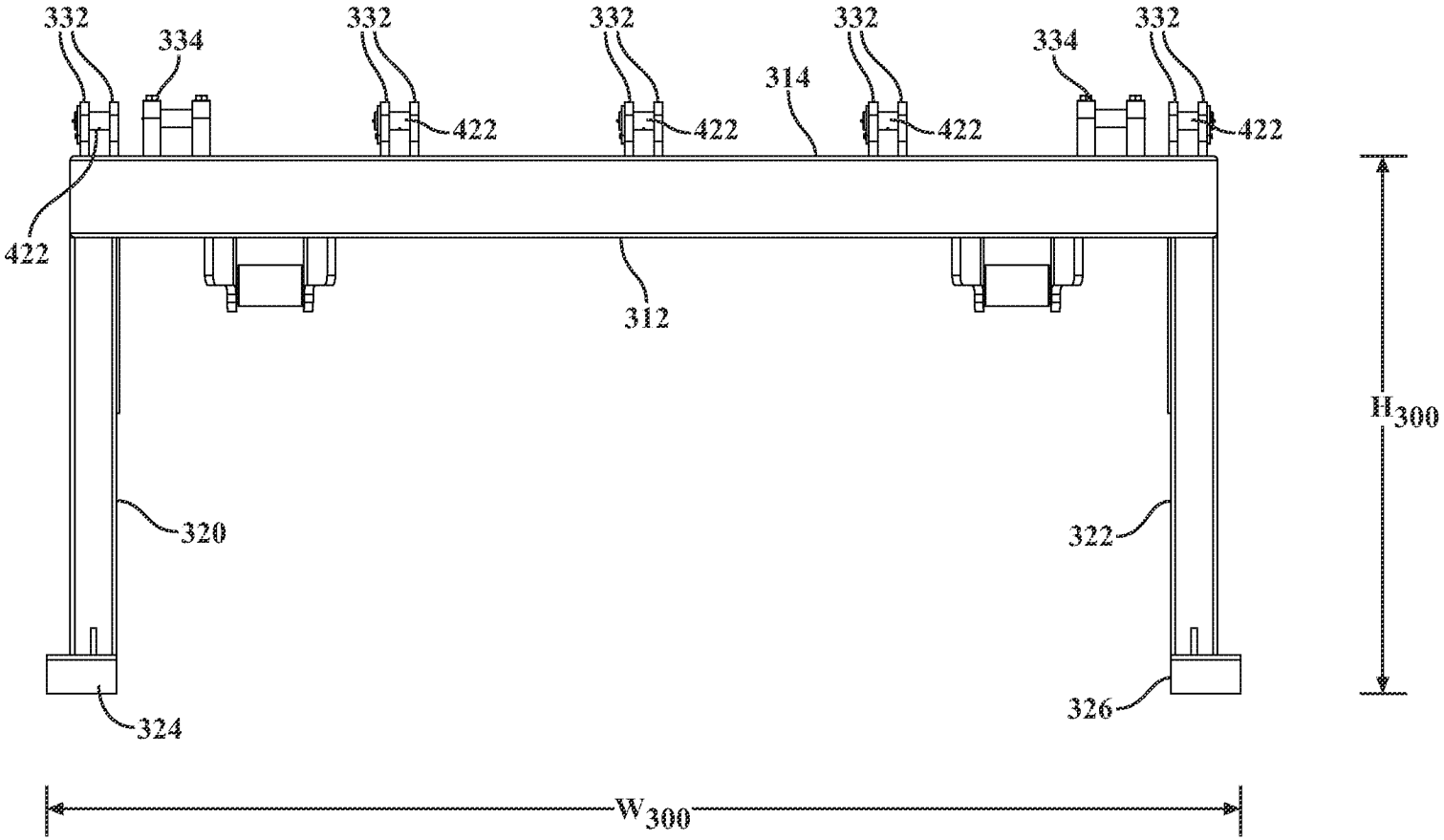
Figure 13:
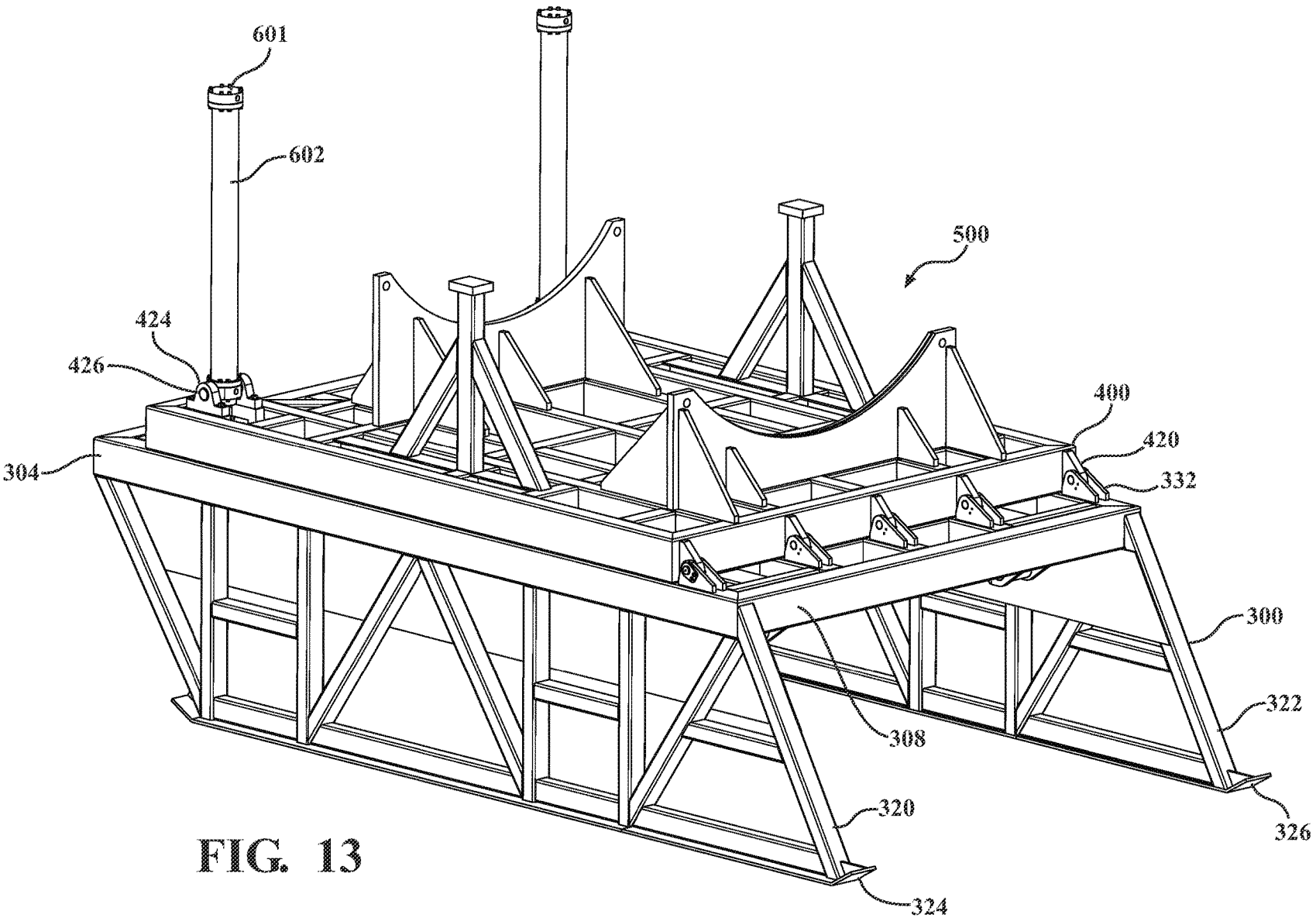
FIGS. 13 and 14 are views of the carrier of FIG. 1 without the metallurgical vessel where the carrier is in the first position.
Figure 14:
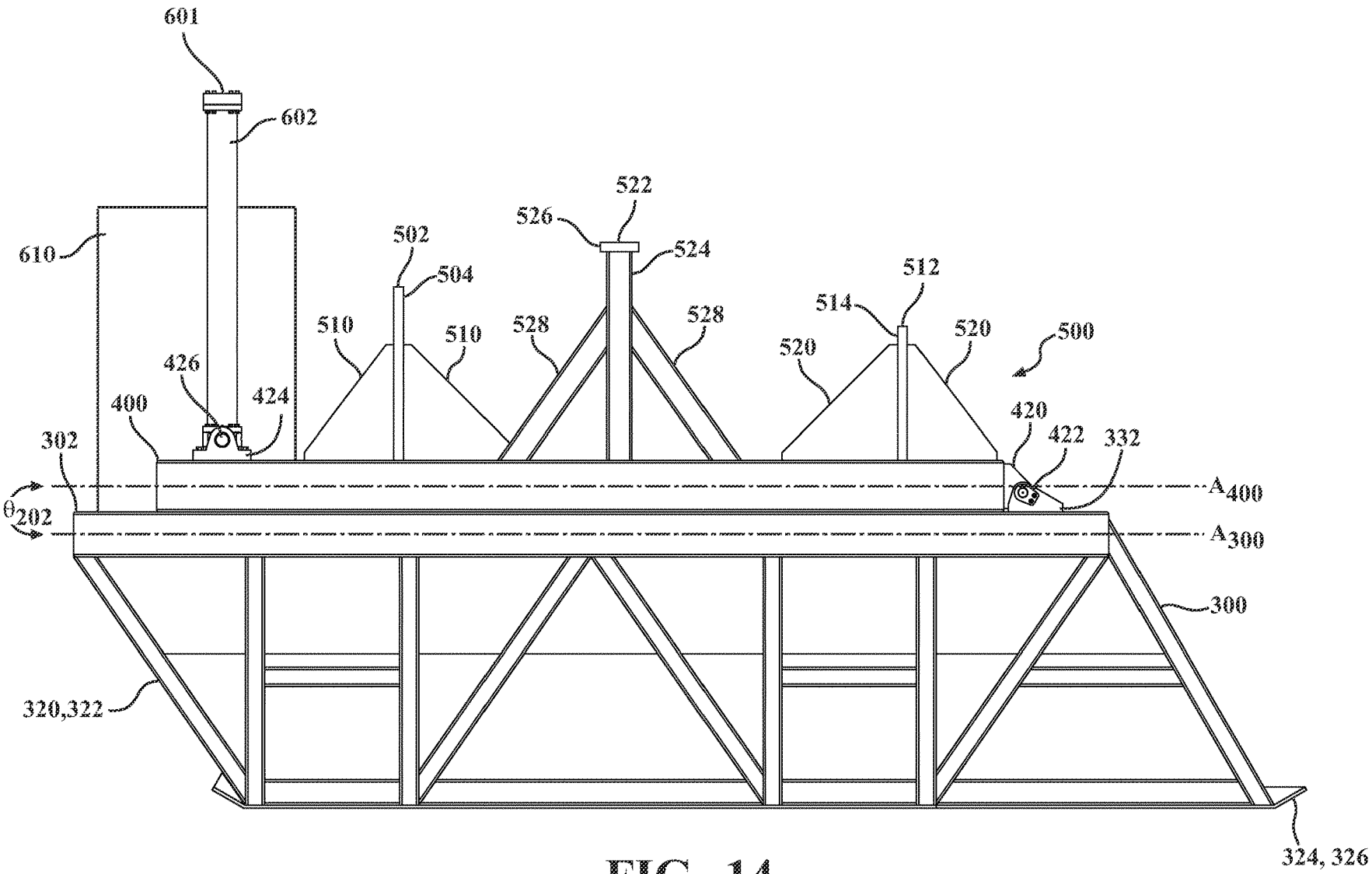
Figure 15:
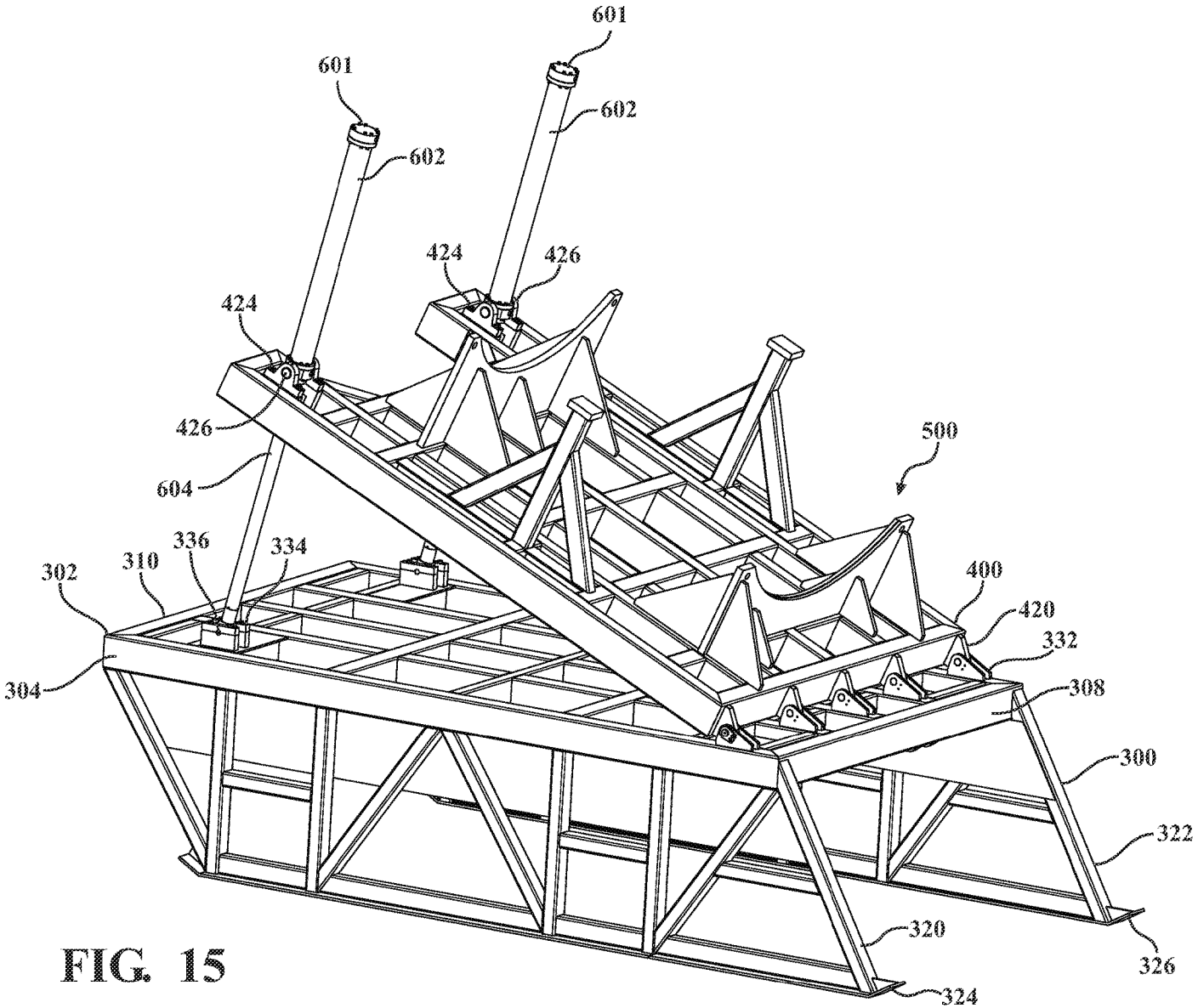
FIGS. 15 and 16 are views of the carrier of FIG. 1 without the metallurgical vessel where the carrier is in the second position.
Figure 16:
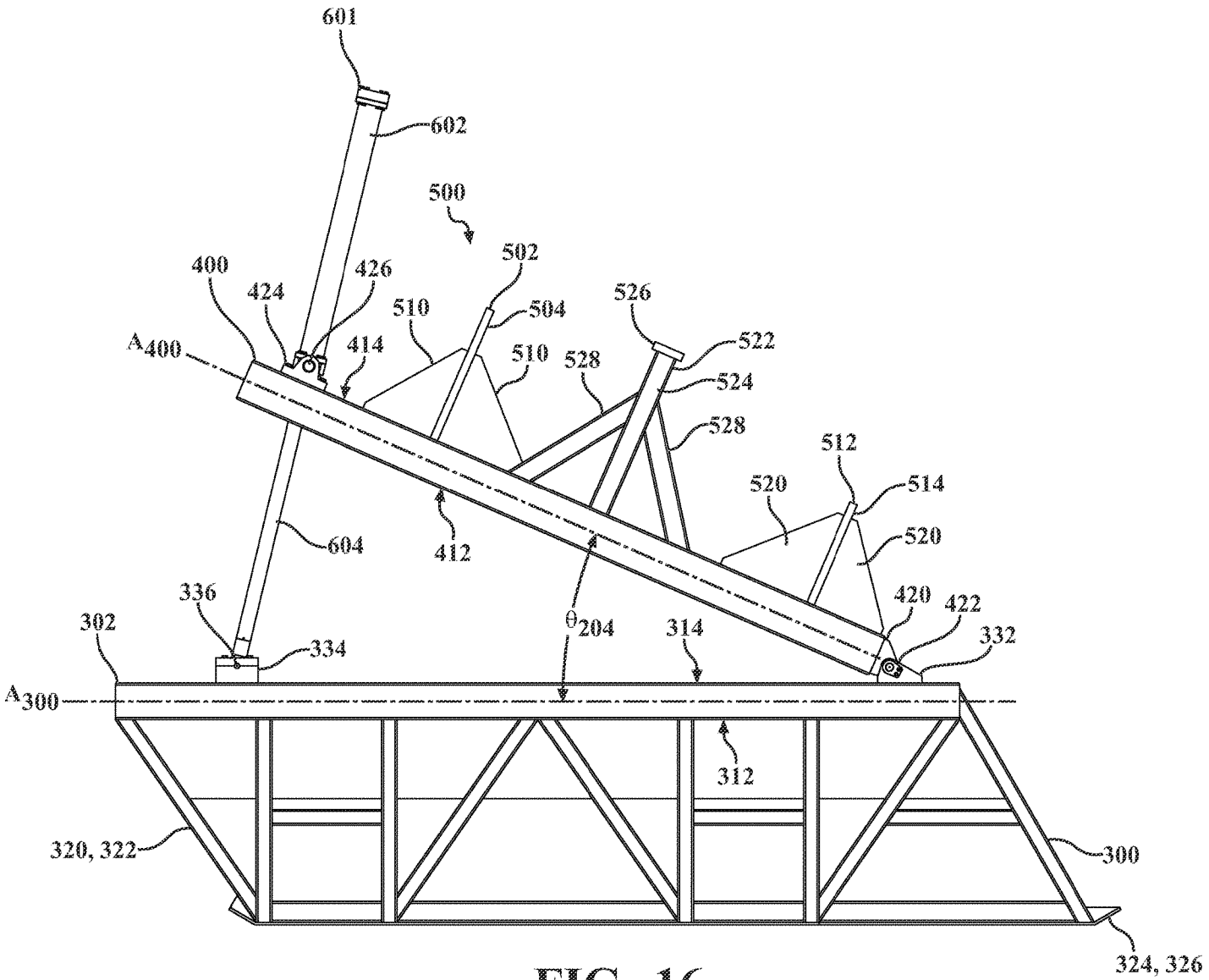

The carrier 200 may be configured to support and tilt and provide mobility to any suitable metallurgical vessel or ladle 100. As shown in FIGS. 6-8, the vessel 100 has a hollow, cylindrical or bucket-shaped construction defined by side walls 102 extending from a circular, planar bottom surface 104 along a longitudinal axis $A_{100}$ of the vessel 100. An outer edge or lip 106 of the side walls 102 opposite the bottom surface 104 defines a circular opening 108 to the vessel 100 such that access to the inner cavity or volume 110 may only be provided via the opening 108. An inner surface 112 of the side walls 102 defines the cavity 110 and the cavity 110 is configured to receive molten material when the vessel 100 is in use in the environment 10.

The side walls 102 of the vessel 100 may extend from the bottom surface 104 perpendicular to the bottom surface (such as to form a straight-sided vessel) or the side walls 102 may extend at an oblique angle relative to the bottom surface 104 to form a tapered or at least partially conical-shaped vessel. In other words, the side walls 102 may extend from the bottom surface 104 at any suitable angle relative to the longitudinal axis $A_{100}$ of the vessel 100. Thus, and as shown in the illustrated embodiment, the vessel 100 may have a first outer diameter $D_{100a}$ at a first position along the longitudinal axis $A_{100}$ of the vessel 100 and a second outer diameter $D_{100b}$ at a second position along the longitudinal axis $A_{100}$ of the vessel 100 where the first outer diameter $D_{100a}$ and the second outer diameter $D_{100b}$ have different values. For example, if the second outer diameter $D_{100b}$ is measured at a position along the longitudinal axis $A_{100}$ of the vessel 100 closer to the opening 108 of the vessel 100 than the first outer diameter $D_{100a}$, the second outer diameter $D_{100b}$ will be greater than the first outer diameter $D_{100a}$. The longitudinal axis $A_{100}$ may extend through both a center point $C_{104}$ of the circular and planar bottom surface 104 and a center point $C_{108}$ of the circular opening 108.

The inner surface 112 of the vessel 100 may be lined with a non-permanent refractory lining, such as brick, to protect the structure of the vessel 100 during use. As discussed above, this refractory lining may deteriorate during use and/or molten material may cool and harden within the vessel 100, adhering to the refractory lining or inner surface 112. Thus, the refractory lining must be removed and replaced during the life cycle of the vessel 100 and removal can only be accomplished via access to the cavity 110 of the vessel 100 through the opening 108. Although shown as having a circular opening 108, the opening to the vessel 100 (i.e., the outer edge 106 of the side walls 102) may optionally include a spout or pouring mechanism for directing molten material from the vessel 100 when the vessel 100 is tipped to dispense the molten material.

As shown in FIGS. 9-12, the base 300 supports the pallet 400 and the cradle 500 above the ground surface at a given height $H_{300}$ of the base 300 and a longitudinal axis $A_{300}$ of the base 300 extends along a length $L_{300}$ of the base 300. The base 300 is configured to support the weight of the vessel 100, pallet 400, cradle 500, and tilting mechanism 600 and provides the pivoting attachment for the pallet 400 to enable pivoting of the pallet 400 and vessel 100 relative to the base 300.

For example, in the illustrated embodiment, the base 300 includes a raised planar member or platform 302 supported at the height $H_{300}$ by a first support or support structure or leg 320 and a second support or support structure or leg 322. The first support 320 extends along a first side 304 of the platform 302 along a length $L_{302}$ of the platform 302 and the second support 322 extends along a second side 306 of the platform 302 where the first side 304 and second side 306 define opposing sides of the platform 302 parallel to the longitudinal axis $A_{300}$ of the base 300. The length $L_{302}$ of the platform 302 may define or share the longitudinal axis $A_{300}$ of the base 300. The supports extend along the respective first side 304 and second side 306 along the length $L_{302}$ of the platform 302 between a third or front end 308 and a fourth or rear end 310, where the front end 308 and the rear end 310 define opposing ends of the platform 302 perpendicular to the longitudinal axis $A_{300}$ of the base 300. The front end 308 and the rear end 310 are equal in length and define a width $W_{302}$ of the platform 302, and therefore a width $W_{300}$ of the base 300. Thus, the base 300 and the platform 302 have a substantially rectangular construction.

Although shown as extending from the respective sides of the platform 302, the first support 320 and the second support 322 may extend from a lower or first surface 312 of the platform 302 that faces (and is parallel with) the ground surface and is opposite an upper or second surface 314 of the platform 302. As discussed further below, the cradle 500 may be mounted to or integrally formed with the upper surface 314 of the platform 302.

The platform 302 includes a series of cross-members spanning the length $L_{302}$ and the width $W_{302}$ of the platform 302 between respective edges of the platform. Thus, a series of longitudinal cross-members 316 are parallel to the longitudinal axis $A_{300}$ of the base 300 and span the length $L_{302}$ of the platform 302 and a series of lateral cross-members 318 are perpendicular to the longitudinal axis $A_{300}$ of the base 300 and span the width $W_{302}$ of the platform 302. The cross-members provide strength and rigidity to the base 300 and may be configured to support other components of the carrier 200. For example, and as discussed further below, the cross-members may provide mounting positions for the cradle 500, or for pivoting elements pivotally attaching the pallet 400 to the base 300 and/or mounting positions for a hydraulic system operable to tilt the pallet 400 relative to the base 300.

The first support 320 and the second support 322 are substantially similar and extend along opposing sides of the platform 302. Further, each support may include one or more mobility structures (not shown) or elements that enable mobility of the carrier 200 within the facility. For example, one or more wheels or treads or the like may be mounted at the first support 320 and the second support 322 and contact the ground surface for providing mobility to the carrier 200.

The mobility elements may be self-propelled (such as by a motor disposed at the base 300) or may be movable only under external forces.

In the illustrated embodiment, the mobility structure includes a first skid or runner 324 forming a ground contacting surface of the first support 320 and a second skid or runner 326 forming a ground contacting surface of the second support 322. The respective runners 324, 326 extend along the length of the respective supports and provide a wider ground-contacting surface for the supports 320, 322 so that the carrier 200 may more easily slide along the ground. Thus, the carrier 200 may be moved within the environment 10 by sliding the carrier 200 along the ground on the respective runners 326. The runners 326 may increase the width $W_{300}$ of the overall base 300 to be greater than the width $W_{302}$ of the platform 302, whereas without the runners, the respective supports may align with the first side 304 and the second side 306 of the platform 302 so that the width $W_{300}$ of the base 300 and the width $W_{302}$ of the platform 302 are equal. Additionally, the structure of the carrier 200 allows for the carrier 200 and vessel 100 to be more easily moved within the facility. Typically specialized equipment is required to move the vessel 100 within the facility, such as a slag pot carrier capable to grab and carry the vessel 100 by trunnions 118 protruding from the outer surface 114 of the vessel 100 on opposing sides of the vessel 100. This specialized equipment can be costly, require advanced training, and be difficult to maneuver within the facility. Positioning the vessel 100 at the carrier 200 allows for more standardized equipment, such as flat beds, cranes, or the like, to engage the carrier and move the carrier 200 and vessel 100 within the facility. Additionally, because the carrier 200 provides the tilting function that may normally be provided by equipment such as a slag pot carrier, the vessel 100 need not be transferred between equipment between cleaning and dumping processes.

The first support 320 extends vertically from the first runner 324 to the first side 304 of the platform 302 and the second support 320 extends vertically from the second runner 326 to the second side 306 of the platform 302. The first support 320 and the second support 322 may be formed as trusses that include a series of support structures or beams 328 extending between the respective runners and the platform 302. One or more horizontal ties or cross-beams 330 may extend between adjacent support beams 328 to further support the weight of the carrier 200 and vessel 100 during the cleaning process and/or movement of the vessel 100 within the environment 10.

Optionally, the supports may include any suitable number of supports extending from the lower surface 312 of the platform 302 towards the ground surface to support the base 300. For example, the supports may include legs or stilts extending from each corner of the platform 302 or a solid-construction base providing continuous ground-contacting support across the length $L_{300}$ and width $W_{300}$ of the base 300. Further, the base 300 may rest directly on the ground surface, or substantially at ground surface, such that the platform 302 rests on the ground surface or the pivoting brackets and hydraulic connectors connected to the platform 302 are directly connected to the ground surface. In other words, while the illustrated embodiment includes a base 300 for supporting and attaching the pallet 400, the pallet 400 (and any tilting mechanism) may be disposed at the ground surface of the environment 10.

As shown in FIGS. 13-20, the pallet 400 is pivotally coupled to the base 300 and is pivotable between the first position 202 (FIGS. 13 and 14), where a longitudinal axis $A_{400}$ along a length $L_{400}$ of the pallet 400 is at the first angle $\theta_{202}$ relative to the base 300, and the second position 204 (FIGS. 15 and 16), where the longitudinal axis $A_{400}$ is at the second angle $\theta_{204}$ relative to the base 300. As will be described further below, the cradle 500 is mounted or attached or disposed at the pallet 400 so that, when the vessel 100 is supported by the cradle 500 and the pallet 400 is tilted relative to the base 300, the vessel 100 tilts relative to the base 300.

Similar to the platform 302 of the base 300, the pallet 400 has a rectangular construction that includes a first side 402 and a second side 404 opposing the first side 402, where the first side 402 and the second side 404 are parallel to the longitudinal axis $A_{400}$ of the pallet 400. The first side 402 and the second side 404 extend between a front end 406 and a rear end 408, where the front end 406 and the rear end 408 are perpendicular to the longitudinal axis $A_{400}$ of the pallet 400. The first side 402 and the second side 404 (i.e., the side edges) define the length $L_{400}$ of the pallet 400 and the front end 406 and the rear end 408 define a width $W_{400}$ of the pallet 400.

The pallet 400 includes a lower or first surface 412 that, with the carrier 200 in the first position 202, faces the upper surface 314 of the platform 302, and an upper or second surface 414 opposite the lower surface 412. The cradle 500 is mounted or attached to the upper surface 414 of the pallet 400.

In the illustrated embodiment, the pallet 400 includes a series of cross-members spanning the length $L_{400}$ and the width $W_{400}$ of the pallet 400 between respective edges of the pallet 400. Thus, a series of longitudinal cross-members 416 are parallel to the longitudinal axis $A_{400}$ of the pallet 400 and span the length $L_{400}$ of the pallet 400 and a series of lateral cross-members 418 are perpendicular to the longitudinal axis $A_{400}$ of the base 300 and span the width $W_{400}$ of the pallet 400. In other words, the longitudinal cross-members 416 extend between the front end 406 and the rear end 408 and the lateral cross-members 418 extend between the first side 402 and the second side 404.

Figure 18:
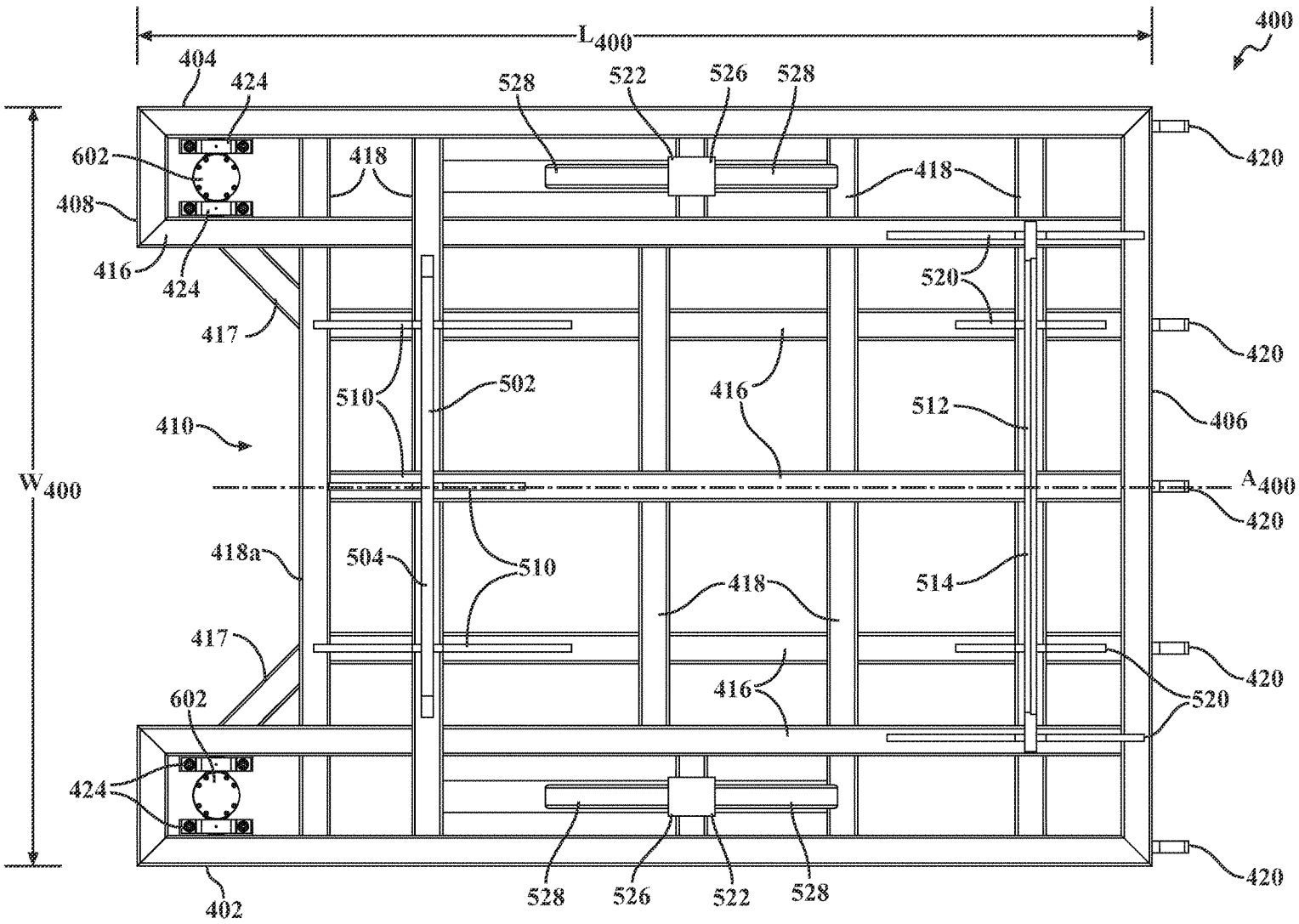

Optionally, a recess 410 may be formed at the rear end 408 such as to accommodate for components of the tilting mechanism 600. For example, and as best shown in FIG. 18, rather than having a rectangular perimeter, the pallet 400 may have a recess 410 along the rear end 408 that provides a gap or space between outer portions of the rear end 408. This gap or space may allow for components to be mounted to the platform 302 of the base 300 (such as the hydraulic system 600) that remain stationary while the pallet 400 pivots relative to the base 300 or for machinery to more easily manipulate the vessel 100 without inadvertently contacting the carrier 200. Here, the recess 410 is defined by a rearmost lateral cross-member **418*a* that is offset from the rear end 408, portions of longitudinal cross-members 416 between the rear end 408 and rearmost lateral cross-member 418*a*, and respective diagonal members 417 connecting between the respective longitudinal cross-members 416 and the rearmost lateral cross-member 418*a***.

Pivoting members mount the pallet 400 to the base 300 so that the pallet 400 may pivot relative to the base 300 when moved between the first position 202 and the second position 204. In the illustrated embodiment, the pivoting members include a series of pivoting brackets or flanges 420 along the front end 406 of the pallet 400 that align with corresponding pivoting brackets or flanges 332 along the upper surface 314 of the platform 302 near or at the first side 304 of the platform 302. For example, each flange 420 extending from the front end 406 of the pallet 400 may be received within a slot between two corresponding flanges 332 extending from the upper surface 314 at the front end 308 of the platform 302, such as one of the cross-members of the base 300. A pivoting member 422, such as a hinge pin or bearing, may extend through and connect the pallet flanges 420 and platform flanges 332 to allow the pallet 400 to pivot relative to the base 300 about the series of hinge pins 422 connecting the corresponding flanges. The width $W_{400}$ of the pallet 400 may be equal to or less than the width $W_{300}$ of the base 300. However, the length $L_{400}$ of the pallet 400 is less than the length $L_{300}$ of the base 300 to allow for room for the pivoting members to pivotally attach the pallet 400 to the upper surface 314 of the base 300.

As will be discussed further below, the pallet 400 further includes brackets or mounting members 424 for connecting the tilting mechanism 600 to the pallet 400 for effectuating movement of the pallet 400 via operation of the tilting mechanism 600. For example, the tilting mechanism 600 may mount to the base 300 via brackets or mounting members 334 disposed at the base 300, such as at one of the cross-members of the base 300, and to the brackets 424 disposed at the pallet 400, such as at one of the cross-members of the pallet 400. Thus, the tilting mechanism 600 may be attached to portions of both the base 300 and the pallet 400 for tilting the pallet 400 relative to the base 300 by lifting one end of the pallet 400 away from the base 300 while the opposite end remains pivotally attached to the base 300 via the hinge pins 422 and associated brackets.

With continued reference to FIGS. 13-20, the cradle 500 is disposed at the upper surface 414 of the pallet 400 and is configured to receive and support the vessel 100 when the vessel 100 is positioned at the carrier 200 to undergo the cleaning process. Optionally, the cradle 500 may be integrally formed with the pallet 400. The cradle 500 may have any suitable configuration for supporting the vessel 100 in a substantially horizontal position when the carrier 200 is in the first position 202 and that secures the vessel 100, or precludes the vessel 100 from sliding or moving relative to the cradle 500 when the pallet 400 is tilted relative to the base 300. For example, the cradle 500 may engage the outer surface 114 of the vessel 100 at one or more positions along the outer surface 114 to retain the vessel 100 at the carrier 200.

Figure 17:
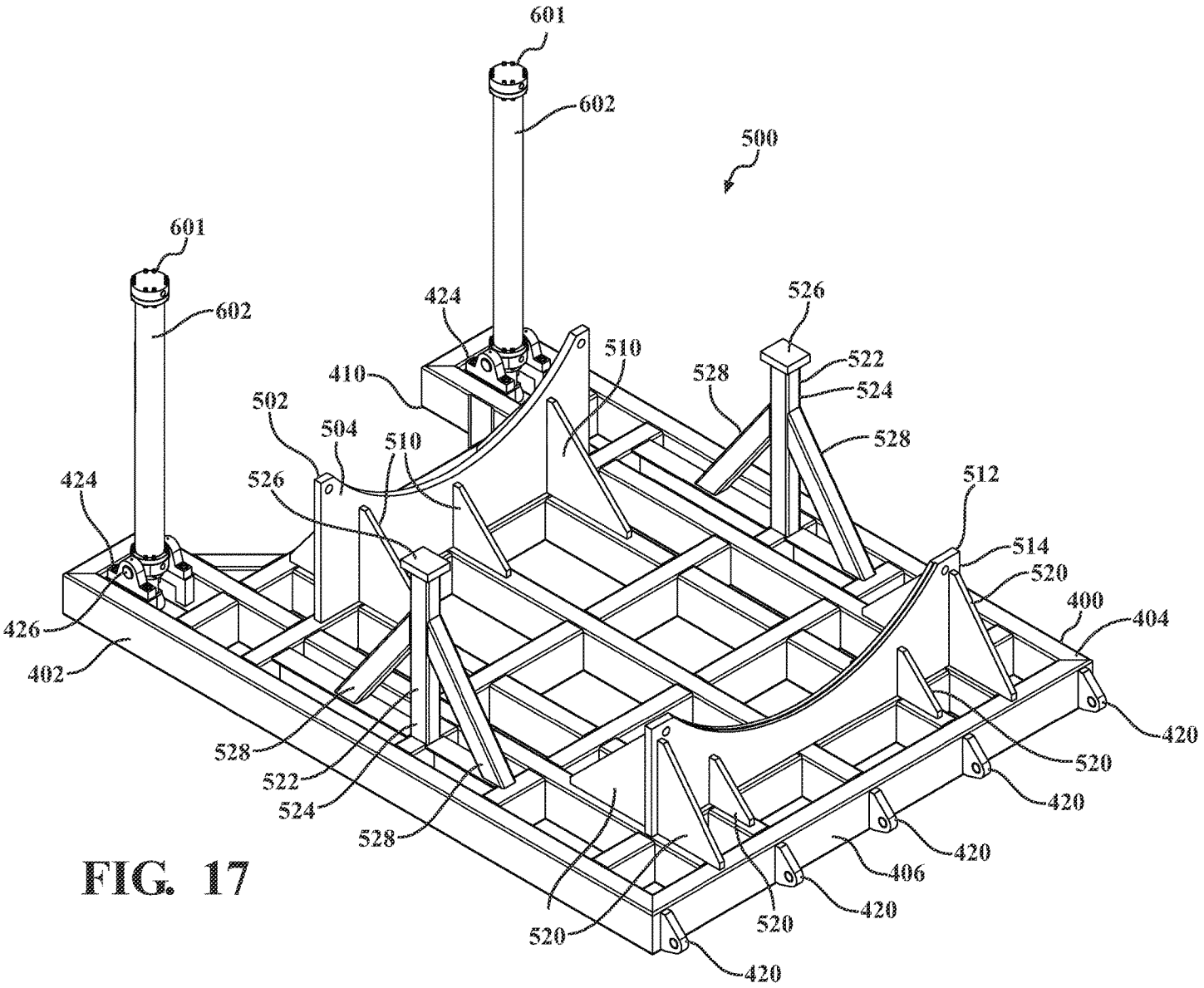
FIGS. 17-20 are views of the pallet and cradle of the carrier.

As best shown in FIG. 17, the cradle 500 includes a first arcuate support or curved portion 502 that is configured to engage the outer surface 114 of the vessel 100 at an axial position along the outer surface 114 that corresponds to the first diameter $D_{100a}$ and a second arcuate support or curved portion 512 that is configured to engage the outer surface 114 of the vessel 100 at an axial position along the outer surface 114 that corresponds to the second diameter $D_{100b}$. Each arcuate support 502, 512 includes a respective curved recess having a radius of curvature that corresponds to the respective outer diameter of the vessel 100 at the axial position of engagement. In other words, the cradle 500 is configured to conform to the vessel 100 or match the shape of the outer surface 114 of the vessel 100 at given locations to ensure the vessel 100 is consistently placed at the carrier 200 each time it is to undergo the cleaning process.

The first arcuate support 502 includes a plate or planar member 504 extending vertically from the upper surface 414 of the pallet 400, such as from one of the lateral cross-members 418 of the pallet 400. The plate 504 includes an arcuate or curved recess 506 along an upper edge of the plate 504 furthest from the pallet 400, where the curved recess 506 has a first radius of curvature $R_{506}$ that corresponds to the first diameter $D_{100a}$ of the vessel 100. One or more holes 508 may be formed through the plate 504, such as to receive fasteners or tie down straps for securing the vessel 100 to the carrier 200 or the like. The plate 504 is supported on opposing sides or faces of the plate 504 by one or more support gussets 510 that each extend from one of the planar faces of the plate 504 to a respective longitudinal cross-member 416 of the pallet 400. In the illustrated embodiment, the plate 504 includes three support gussets 510 extending from each side of the plate 504 and attaching to three individual longitudinal cross-members 416. Both the plate 504 and the support gussets 510 may be mounted to the upper surface 414 of the pallet, such as via welding or bolted attachment.

Similar to the first arcuate support 502, the second arcuate support 512 includes a plate or planar member 514 that extends vertically from the upper surface 414 of the pallet 400 at a position remote from the first arcuate support 502, such as a different one of the lateral cross-members 418. The plate 514 includes an arcuate or curved recess 516 along an upper edge of the plate 504 furthest from the pallet 400 and the curved recess 516 has a second radius of curvature $R_{516}$ that corresponds to the second diameter $D_{100b}$ of the vessel 100. One or more holes 518 are also formed through the plate 514 to, for example, receive fasteners or tie down straps for securing the vessel 100 to the carrier 200. The second arcuate support 512 is supported by respective support gussets 520 that extend from both sides or faces of the plate 514 and mount or attach to respective longitudinal cross-members 416 of the pallet 400. In the illustrated embodiment, the plate 514 includes four support gussets 520 extending from each side of the plate 514 and attaching to four individual longitudinal cross-members 416, where both the plate 514 and the support gussets 520 may be mounted to the upper surface 414 of the pallet 400.

Further, the cradle 500 may include anti-rotation supports or risers 522 configured to engage elements of the vessel 100 on opposing sides of the vessel 100 so that, during the cleaning process, the vessel 100 is prevented from rotating or spinning about its longitudinal axis $A_{100}$. In the illustrated embodiment, the anti-rotation supports 522 are positioned along the first side 402 and the second side 404 of the pallet 400 and extend vertically from the upper surface 414 of the pallet 400 to engage respective protrusions 116 on opposing sides of the vessel 100. Optionally, the anti-rotation supports 522 may be configured to engage respective trunnions 118 (the vessel 100 may be suspended from a crane when in the working area by the trunnions 118) on opposing sides of the vessel 100. Thus, during the cleaning process, if forces urge the vessel 100 to rotate or spin, the engagement of the anti-rotation support 522 on opposing sides of the vessel 100 precludes the vessel 100 from rotating or spinning in either direction (clockwise or counter-clockwise) about its longitudinal axis $A_{100}$.

Each anti-rotation support 522 includes a vertical beam or pillar 524 extending from (and mounted to or integrally formed with) the upper surface 414 of the pallet 400, such as at the respective first side 402 or second side 404 or at respective cross-members near the respective sides. An engagement plate 526 may be disposed at the distal ends of the respective beams 524, distal from the pallet 400. When the vessel 100 is positioned at the carrier 200, the engagement plates 526 are configured to receive the opposing protrusions 116 of the vessel 100. The vertical beams 524 are supported by respective braces 528 extending from opposing front and rear-facing sides of the respective beams 524. The braces 528 may extend at an angle from the vertical beams 524 so as to mount or attach in front of and behind (along the longitudinal axis $A_{400}$ of the pallet 400) the beams 524.

Although shown as including only a single anti-rotation support 522 on each side of the vessel 100, the cradle 500 may include any suitable number of anti-rotation supports 522 along the length of the vessel 100. Further, the height of the vertical beam 524 and the configuration of the engagement surface 526 may be tailored to the configuration of the vessel 100. For example, the engagement portion 526 may include a hook or loop or arcuate cradle configured to engage and support the trunnion 118 of the vessel 100.

Figure 19:
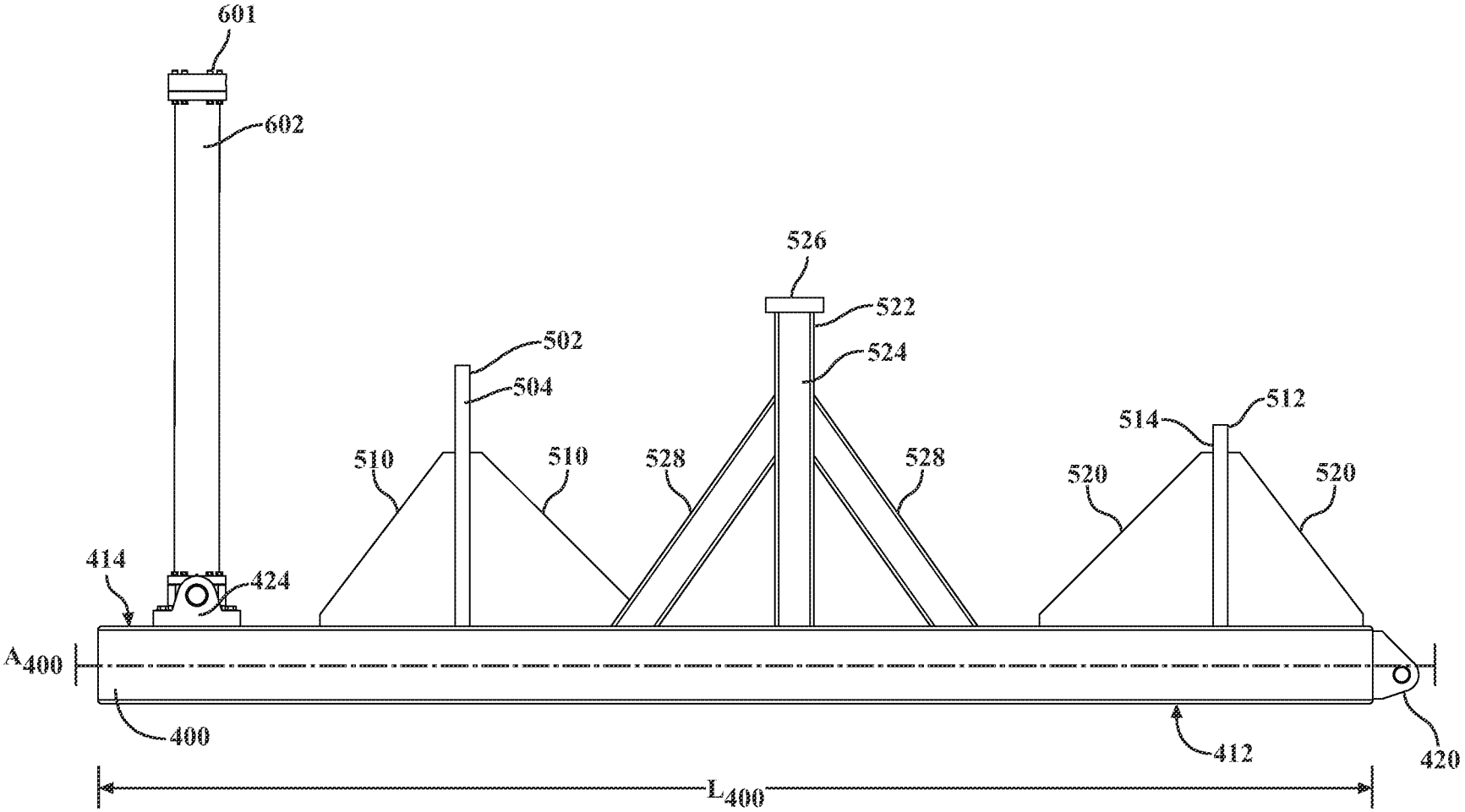
Figure 20:
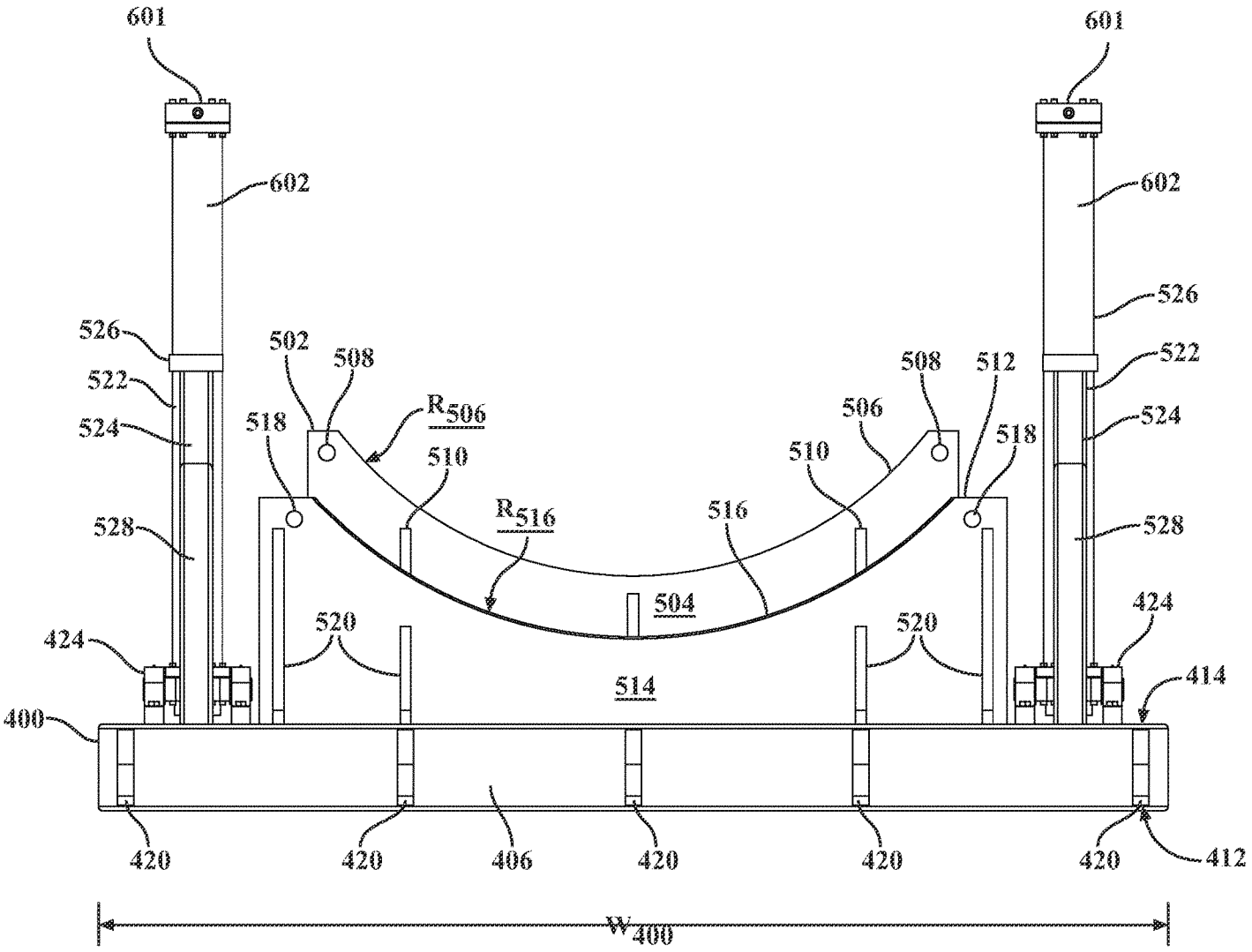

As shown in FIGS. 19 and 20, the second arcuate support 512 is shorter than the first arcuate support 502 to accommodate the increase in diameter of the vessel 100 from the first position and first outer diameter $D_{100a}$ to the second position and second outer diameter $D_{100b}$. In other embodiments, the heights and configurations of the respective arcuate supports may be tailored to the dimensions of the vessel 100 and the desired resting and tilted angle positions of the pallet 400 and vessel 100 relative to the base 300 and ground surface.

Additionally, the components of the cradle 500 may be configured to accommodate unique configurations of the vessel 100. For example, in the illustrated embodiment, the vessel 100 includes one or more lips or flanges 120 extending from the outer surface 114 of the vessel 100 and the second arcuate support 512 is positioned to engage the vessel 100 between adjacent flanges 120. Thus, when the carrier 200 tilts the vessel 100, the second arcuate support 512 may engage one of the flanges 120 to prevent the vessel 100 from sliding off the carrier 200.

One or more portions of the cradle 500, such as the first arcuate support 502, second arcuate support 504, and the respective anti-rotation supports 522, may be removable and repositionable at the upper surface 414 of the pallet 400 to adjust the configuration of the cradle 500 to receive different vessels. For example, arcuate supports having different radii of curvature may be swapped for one another to accommodate vessels having different outer diameters at an engagement position of the outer surface of the vessel. Similarly, the anti-rotation supports 522 may be repositioned at the pallet 400 to accommodate positioning of protrusions 116 and trunnions 118 of the vessel 100.

Optionally, the cradle 500 and the pallet 400 may be integrally formed such that the pallet 400 (with cradle integrated) may be removed from and replaced at the base 300 to accommodate the differing vessels. In such scenarios, the tilting mechanism 600 may be integrated with the base 300 and mount to the pallet 400 when the accommodating pallet 400 is pivotally mounted at the base. Thus, the differing pallets may share universal flanges 420 or pivoting members configured to pivotally attach at the base 300 and universal brackets 424 configured to receive and attach to the tilting mechanism 600.

As discussed above, the pallet 400 and cradle 500 (and therefore vessel 100) may be tiltable or pivotable or adjustable relative to the base 300 via operation of a tilting mechanism 600, such as a hydraulic system. In the illustrated embodiment, the hydraulic system 600 is integrated into the base 300 of the carrier 200. In other words, the control, pump, and any associated hoses or other hardware of the hydraulic system 600 are disposed at the base 300. Particularly, a hydraulic power unit 610 of the hydraulic system 600 may be supported at the rear end 310 of the base 302 in an area associated with the recess 410 of the pallet 400. Thus, when the pallet 400 is in the first position (i.e., horizontal against the base 300), the hydraulic system 600 is received within the recess 410 of the pallet 400. This configuration allows the carrier 200 to provided as an integrated unit that can be easily transported. Additionally, positioning the hydraulic power unit 610 within the recess 410 provides improved protection and minimizes the complexity of the hydraulic routing between the hydraulic power unit 610 and the cylinder 601, discussed below.

The hydraulic system 600 includes a pair of hydraulic cylinders 601 each including a cylinder barrel 602 are mounted or otherwise attached to the pallet 400 and a hydraulic piston rod 604 is mounted or otherwise attached to the base 300 so that, when the hydraulic system 600 is operated, the piston rod 604 may extend from the cylinder barrel 602, biasing the rear end 408 of the pallet 400 away from the base 300. Any suitable hydraulic system may be utilized.

Here, a head of the cylinder barrel 602 pivotally attaches to the pallet 400 and the piston rod 604 pivotally attaches to the base 300 so that the linear motion of the hydraulic system 600 may be translated to pivotal movement of the pallet 400 relative to the base 300. For example, and as shown in FIGS. 17 and 18, the head of the cylinder barrel 602 may be received between adjacent flanges or brackets 424 of the pallet 400 and pivotally connected to the flanges 424 by way of a hinge pin 426. The flanges 424 may extend from adjacent cross-members of the pallet 400 where the piston rod 604 extends from the cylinder barrel 602 through a gap between the adjacent cross-members. The piston 604 may be received between adjacent flanges or brackets 334 of the base 300 and pivotally connected to the flanges 334 by way of a hinge pin 336. The flanges 334 may extend from respective mounting positions along the platform 302 of the base 300, such as one or more of the cross-members or the respective first side 304 or second side 306. Thus, the cylinder barrel 602 and the piston rod 604 are pivotable relative to the pallet 400 and the base 300 during linear translation of the piston rod 604 from the cylinder barrel 602 to accommodate the pivotal relationship between the pallet 400 and the base 300.

While the illustrated example of the hydraulic system 600 shows the cylinder barrel 602 attached to the pallet 400 and the piston rod 604 attached to the base 300, this configuration may be reversed so that the cylinder barrel 602 is pivotally coupled at the brackets 334 of the base 300 and the piston rod 604 is pivotally attached at the brackets 424 of the pallet. Thus, during operation the cylinder barrel 602 remains stationary relative to the base 300 while the piston rod 604 extends and retracts with the pallet 400. Accordingly, when the hydraulic power unit 610 is supported on the frame 300, the hydraulic lines will connect to the cylinder barrel 602 and will remain stationary. This configuration allows for a fixed-length hydraulic lines to be used to eliminates the need for movable couplings and lines.

Optionally, the hydraulic system 600 may include a control 606 in communication with the hydraulic system 600 and operable to transmit signals to the hydraulic system 600 to control the tilting action of the carrier 200 responsive to user inputs received at the control 606. For example, the control 606 may include a control panel disposed at the carrier 200 that receives inputs from the user to operate the hydraulic system 600. Optionally, the control 606 may be remote from the carrier 200 and in wireless communication with the hydraulic system 600 so that the user may be distanced from the carrier 200 (such as in a control room of the facility or a cab of the excavator 12) during operation of the titling function and communicate with the hydraulic system via wireless signal 608 transmitted between the control 606 and the hydraulic system 600 (see FIG. 4). This may improve safety as the user need not approach the vessel 100, heated waste material, or carrier 200 to tilt the vessel between the resting and dumping positions.

The tilting mechanism 600 may be operable to adjust position of the carrier 200 and vessel 100 to any suitable angle. For example, when the carrier 200 is in the first position 202, the longitudinal axis $A_{400}$ of the pallet 400 and the longitudinal axis $A_{300}$ of the base may be parallel to one another such that the first angle $\theta_{202}$ of the pallet 400 relative to the base 300 at the first position 202 is 0 degrees. Optionally, the first angle $\theta_{202}$, or default or resting position 202 of the carrier 200, may be greater or less than 0 degrees such as to slightly tilt the vessel 100 upwards or downwards along its longitudinal axis $A_{100}$ when positioned at the carrier 200. The tilting mechanism 600 may pivot the pallet 400 to any suitable angle relative to the base 300 so that the cavity 110 of the vessel 100 may be more easily accessed and waste material may be more easily loosened and removed from the vessel 100. For example, the pallet 400 may be pivoted 5 degrees, 10 degrees, 20 degrees, 30 degrees, 45 degrees, or more relative to the base 300. Thus, when the carrier 200 is in the second position 204, the longitudinal axis $A_{400}$ of the pallet 400 and the longitudinal axis $A_{300}$ of the base may be at a second angle $\theta_{204}$ relative to one another that is greater than the first angle $\theta_{202}$, such as 5 degrees, 10 degrees, 20 degrees, 30 degrees, 45 degrees, or more than the first angle $\theta_{202}$.

The carrier 200 as described herein may be suitable for use in a number of industrial environments and may enhance cleaning processes of metallurgical vessels 100 in a variety of ways. For example, the carrier 200 may be operated to tilt the metallurgical vessel 100 during and/or after the cleaning process to improve accessibility to the cavity 110 of the vessel and make removal of waste material from the vessel 100 easier. This improves efficiency within the facility as the vessel 100 may be more quickly cleaned and returned to service. Additionally, the carrier 200 may improve mobility of the vessel 100 within the facility as the carrier 200 may have an integrated mobility feature, such as skids or runners or wheels or tracks, or may be more easily moved within the facility by industrial equipment.

Further, because the carrier 200 supports the vessel 100 in a stationary, repeatable, and consistent position, the carrier 200 may be suitable for use with an automated cleaning process, where an automated cleaning machine or tool is used to provide repeatable cleaning results without intervention from an operator.

Figure 21:
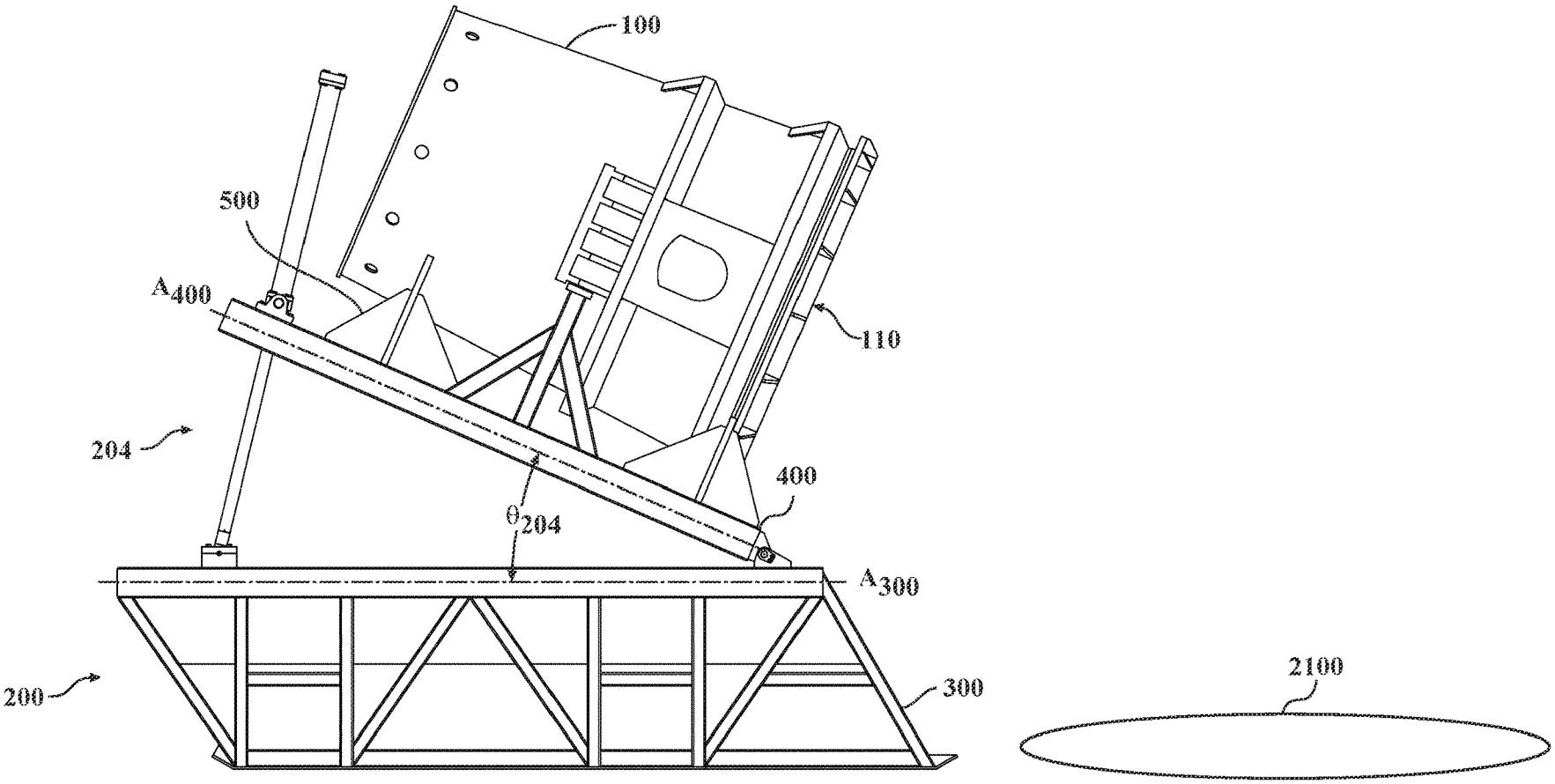
FIG. 21 is an environmental view of the carrier and vessel of FIG. 1 where the carrier is in the tilting position so that loosened material may fall from the vessel to a receptacle positioned at or near the carrier.

Optionally, and as shown in FIG. 21, a conveyor or hopper or other receptacle 2100 may be positioned proximal to the carrier 200 (or optionally the carrier may be positioned proximal to the receptacle 2100) so that, when the vessel 100 is tilted (i.e., the carrier 200 is moved to the dumping position 204), loosened material within the vessel 100 may fall from the interior cavity 110 of the vessel 100 and into or onto the receptacle 2100 for easier removal of the material from the cleaning area.

The carrier 200 and its associated components may be fashioned from any material suitable to withstand the weight of the vessel 100, forces applied upon the vessel 100 and waste material during the cleaning process, and heat from the vessel 100, waste material, and industrial environment 10. Additionally, the coupling or attachment of components to one another, such as the pivotal attachment of the pallet 400 and base 300 or fixed attachment of the cradle 500 to the pallet 400, may be accomplished in any manner suitable to withstand the forces and extreme temperatures to which the carrier 200 may be subjected. For example, the carrier 200 may be formed primarily from hollow or solid tubing of heat resistant metallic alloys.

Figure 22:
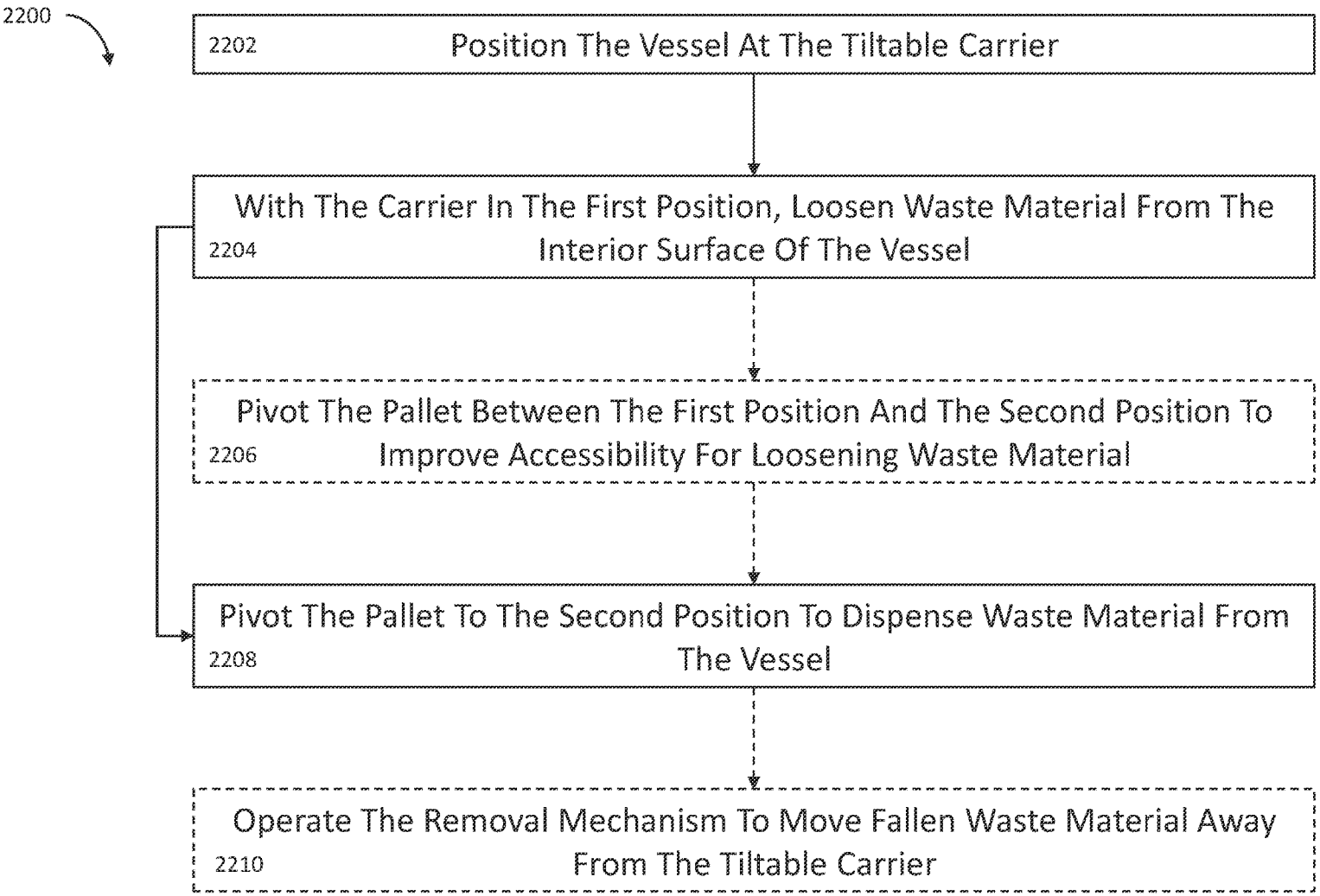
FIG. 22 is a flowchart of a method for removing waste material from a vessel with use of the carrier.

FIG. 22 is a flowchart of an example arrangement of operations of a method 2200 for removing waste material from a vessel 100 in a metallurgical or foundry setting 10 with use of the tiltable carrier 200 as described herein. The method 2200 may employ the use of a human operator or be a computer-implemented method stored on memory and executed by data processing hardware in communication with the memory, such as the control 606 in communication with the hydraulic system 600. At operation 2202, the method 2200 includes positioning the vessel 100 at the carrier 200. The carrier 200 may exhibit any number of the features described above. At operation 2204, with the vessel 100 positioned at the carrier 200 and with the carrier 200 in the first position 202, the method 2200 includes loosening waste material from the inner surface 112 of the vessel 100. For example, the waste material may be loosened using the excavator 12 and boom attachment 14. Optionally, at operation 2206 the method 2200 may include pivoting the pallet 400 between the first position 202 and the second position 204 (and optionally discrete positions between the first position 202 and the second position 204) to adjust the angle $\theta_{100}$ of the longitudinal axis $A_{100}$ of the vessel 100 to improve accessibility to the interior surface 112 of the vessel 100. At operation 2208, after loosening the waste material from the inner surface 112 of the vessel 100, the method 2200 includes pivoting the pallet 400 to the second position 204 to dispense waste material from the vessel 100. A receptacle 2100 and/or removal mechanism, such as a conveyor or hopper, may be positioned proximal to the carrier 200 and vessel 100 during the cleaning process so that, at optional operation 2210, the method 2200 includes operating the conveyor or hopper of the receptacle 2100 to move fallen waste material away from the carrier 200.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

Clause 1: A carrier for supporting a metallurgical vessel during a cleaning process of the metallurgical vessel, the carrier including a base comprising a longitudinal axis along a length of the base; a pallet coupled to the base and pivotable between (i) a first position where a longitudinal axis along a length of the pallet is at a first angle relative to the longitudinal axis of the base, and (ii) a second position where the longitudinal axis of the pallet is at a second angle relative to the longitudinal axis of the base, the second angle greater than the first angle; and a cradle disposed at the pallet and configured to support the metallurgical vessel when the metallurgical vessel is positioned at the carrier for the cleaning process, whereby pivoting the pallet between the first position and the second position adjusts an angle of a longitudinal axis of the metallurgical vessel relative to the longitudinal axis of the base.

Clause 2: The carrier of clause 1, wherein the pallet is pivotable between the first position and the second position via operation of a tilting mechanism.

Clause 3: The carrier of clause 2, wherein the tilting mechanism comprises a hydraulic system disposed at the carrier, the hydraulic system operable to pivot the pallet between the first position and the second position responsive to a user input at a control of the hydraulic system.

Clause 4: The carrier of clause 3, wherein the control of the hydraulic system is remote from the carrier and in wireless communication with the carrier for operation of the hydraulic system.

Clause 5: The carrier of clause 1, wherein the longitudinal axis of the base is parallel to a ground surface at which the carrier is disposed.

Clause 6: The carrier of clause 1, wherein the longitudinal axis of the pallet is parallel to the longitudinal axis of the base when the pallet is in the first position.

Clause 7: The carrier of clause 1, wherein the second angle is at least 10 degrees greater than the first angle.

Clause 8: The carrier of clause 1, wherein the longitudinal axis of the metallurgical vessel is parallel to the longitudinal axis of the pallet when the metallurgical vessel is positioned at the carrier.

Clause 9: The carrier of clause 1, wherein the cradle engages an outer surface of the metallurgical vessel to support the metallurgical vessel at the carrier.

Clause 10: The carrier of clause 9, wherein the cradle comprises (i) a first support configured to engage the outer surface of the metallurgical vessel at a first axial position and defines a first radius of curvature corresponding to a first diameter of the metallurgical vessel at the first axial position, and (ii) a second support configured to engage the outer surface of the metallurgical vessel at a second axial position and defines a second radius of curvature corresponding to a second diameter of the metallurgical vessel at the second axial position.

Clause 11: The carrier of clause 9, wherein the cradle comprises a first anti-rotation support along a first side of the pallet that prevents the metallurgical vessel from rotating in a first direction when the metallurgical vessel is positioned at the carrier and engages the first anti-rotation support.

Clause 12: The carrier of clause 1, wherein a series of flanges disposed along a first edge of the pallet are pivotally coupled to adjacent corresponding flanges disposed along an upper surface of the base to pivotally attach the pallet to the base.

Clause 13: The carrier of clause 1, wherein the base comprises (i) a raised platform having a length that defines the longitudinal axis of the base, (ii) a first support structure extending along a first edge region of the raised platform and parallel to the longitudinal axis of the base, and (iii) a second support structure extending along a second edge region of the raised platform opposite the first edge region and parallel to the longitudinal axis of the base.

Clause 14: The carrier of clause 13, wherein a respective runner is disposed along a length of each of the first support structure and the second support structure.

Clause 15: The carrier of clause 1, wherein the carrier is positioned proximal to a receptacle so that, when the longitudinal axis of the metallurgical vessel is adjusted, material within the metallurgical vessel may fall to the receptacle.

Clause 16: A carrier for supporting a metallurgical vessel during a cleaning process of the metallurgical vessel, the carrier comprising: a base comprising (i) a raised platform having a length that defines a longitudinal axis of the base, (ii) a first support structure extending along a first edge region of the raised platform and parallel to the longitudinal axis of the base, and (iii) a second support structure extending along a second edge region of the raised platform opposite the first edge region and parallel to the longitudinal axis of the base; a pallet pivotally disposed at the base and pivotable between (i) a first position where a longitudinal axis along a length of the pallet is at a first angle relative to the longitudinal axis of the base, and (ii) a second position where the longitudinal axis of the pallet is at a second angle relative to the longitudinal axis of the base, the second angle greater than the first angle; a tilting mechanism disposed at the carrier and operable to pivot the pallet between the first position and the second position responsive to a user input at a control of the tilting mechanism; and a cradle disposed at the pallet and configured to support the metallurgical vessel when the metallurgical vessel is positioned at the carrier for the cleaning process, whereby pivoting the pallet between the first position and the second position adjusts an angle of a longitudinal axis of the metallurgical vessel relative to the longitudinal axis of the base.

Clause 17: The carrier of clause 16, wherein the tilting mechanism comprises a hydraulic system disposed at the carrier.

Clause 18: The carrier of clause 16, wherein the control of the tilting mechanism is remote from the carrier and in wireless communication with the carrier for operation of the tilting mechanism.

Clause 19: The carrier of clause 16, wherein the longitudinal axis of the base is parallel to a ground surface at which the carrier is disposed.

Clause 20: The carrier of clause 16, wherein the longitudinal axis of the pallet is parallel to the longitudinal axis of the base when the pallet is in the first position.

Clause 21: The carrier of clause 16, wherein the second angle is at least 10 degrees greater than the first angle.

Clause 22: The carrier of clause 16, wherein the cradle is configured to align the longitudinal axis of the metallurgical vessel parallel to the longitudinal axis of the pallet when the metallurgical vessel is positioned at the carrier.

Clause 23: The carrier of clause 16, wherein the cradle is configured to engage an outer surface of the metallurgical vessel to support the metallurgical vessel at the carrier.

Clause 24: The carrier of clause 23, wherein the cradle comprises (i) a first support configured to engage the outer surface of the metallurgical vessel at a first axial position and that defines a first radius of curvature corresponding to a first diameter of the metallurgical vessel at the first axial position, and (ii) a second support configured to engage the outer surface of the metallurgical vessel at a second axial position and that defines a second radius of curvature corresponding to a second diameter of the metallurgical vessel at the second axial position.

Clause 25: The carrier of clause 23, wherein the cradle comprises a first anti-rotation support along a first side of the pallet that prevents the metallurgical vessel from rotating in a first direction when the metallurgical vessel is positioned at the carrier and engages the first anti-rotation support.

Clause 26: The carrier of clause 16, wherein a series of flanges disposed along a first edge of the pallet are pivotally coupled to adjacent corresponding flanges disposed along an upper surface of the base to pivotally attach the pallet to the base.

Clause 27: The carrier of clause 16, wherein a respective runner is disposed along a length of each of the first support structure and the second support structure.

Clause 28: The carrier of clause 16, wherein the carrier is positioned proximal to a receptacle so that, when the longitudinal axis of the metallurgical vessel is adjusted, material within the metallurgical vessel may fall to the receptacle.

Clause 29: A method for removing waste material from a metallurgical vessel during a cleaning process of the metallurgical vessel, the method including: positioning a metallurgical vessel at a tiltable carrier, the tiltable carrier having: a base comprising a longitudinal axis along a length of the base; a pallet pivotally disposed at the base and pivotable between (i) a first position where a longitudinal axis along a length of the pallet is at a first angle relative to the longitudinal axis of the base, and (ii) a second position where the longitudinal axis of the pallet is at a second angle relative to the longitudinal axis of the base, the second angle greater than the first angle; and a cradle disposed at the pallet and configured to support the metallurgical vessel when the metallurgical vessel is positioned at the tiltable carrier; with the metallurgical vessel positioned at the tiltable carrier and with the pallet in the first position, loosening waste material from an interior surface of the metallurgical vessel; and after loosening waste material from the interior surface of the metallurgical vessel, pivoting the pallet to the second position to dispense loosened waste material from the metallurgical vessel, whereby pivoting the pallet between the first position and the second position adjusts an angle of a longitudinal axis of the metallurgical vessel relative to the longitudinal axis of the base.

Clause 30: The method of clause 29, wherein the pallet is pivotable between the first position and the second position via operation of a hydraulic system disposed at the tiltable carrier, the hydraulic system operable to pivot the pallet between the first position and the second position responsive to a user input at a control of the hydraulic system.

Clause 31: The method of clause 29, wherein the tiltable carrier is positioned proximal to a receptacle so that, while dispensing the loosened waste material from the metallurgical vessel, the waste material may fall to the receptacle.

Clause 32: The method of clause 31, wherein: the receptacle comprises a conveyor or a hopper; and the method includes operating the conveyor or the hopper to move fallen waste material away from the tiltable carrier.

Clause 33: The method of clause 29, wherein the second angle is at least 10 degrees greater than the first angle.

Clause 34: The method of clause 29, wherein the method includes, while loosening waste material from the interior surface of the metallurgical vessel, pivoting the pallet between the first position and the second position to adjust the angle of the longitudinal axis of the metallurgical vessel to improve accessibility to the interior surface of the metallurgical vessel.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

A number of implementations have been described. Nevertheless, it will be understood that various modifications may be made without departing from the spirit and scope of the disclosure. Accordingly, other implementations are within the scope of the following claims.

What is claimed is:

1. A carrier for supporting a metallurgical vessel during a cleaning process of the metallurgical vessel, the carrier comprising:

a base comprising a longitudinal axis along a length of the base;

a pallet coupled to the base and pivotable between (i) a first position where a longitudinal axis along a length of the pallet is at a first angle relative to the longitudinal axis of the base, and (ii) a second position where the longitudinal axis of the pallet is at a second angle relative to the longitudinal axis of the base, the second angle greater than the first angle;

a cradle disposed on the pallet and configured to support the metallurgical vessel when the metallurgical vessel is positioned on the carrier for the cleaning process, whereby pivoting the pallet between the first position and the second position adjusts an angle of a longitudinal axis of the metallurgical vessel relative to the longitudinal axis of the base, and a tilting mechanism including a hydraulic system disposed on the carrier, the hydraulic system operable to pivot the pallet between the first position and the second position responsive to a user input at a control of the hydraulic system.

2. The carrier of claim 1, wherein the control of the hydraulic system is remote from the carrier and in wireless communication with the carrier for operation of the hydraulic system.

3. The carrier of claim 1, wherein the longitudinal axis of the base is parallel to a ground surface on which the carrier is disposed.

4. The carrier of claim 1, wherein the longitudinal axis of the pallet is parallel to the longitudinal axis of the base when the pallet is in the first position.

5. The carrier of claim 1, wherein the second angle is at least 10 degrees greater than the first angle.

6. The carrier of claim 1, wherein the longitudinal axis of the metallurgical vessel is parallel to the longitudinal axis of the pallet when the metallurgical vessel is positioned at the carrier.

7. The carrier of claim 1, wherein the cradle engages an outer surface of the metallurgical vessel to support the metallurgical vessel at the carrier.

8. The carrier of claim 7, wherein the cradle comprises (i) a first support configured to engage the outer surface of the metallurgical vessel at a first axial position and defines a first radius of curvature corresponding to a first diameter of the metallurgical vessel at the first axial position, and (ii) a second support configured to engage the outer surface of the metallurgical vessel at a second axial position and defines a second radius of curvature corresponding to a second diameter of the metallurgical vessel at the second axial position.

9. The carrier of claim 7, wherein the cradle comprises a first anti-rotation support along a first side of the pallet that prevents the metallurgical vessel from rotating in a first direction when the metallurgical vessel is positioned at the carrier and engages the first anti-rotation support.

10. The carrier of claim 1, wherein a series of flanges disposed along a first edge of the pallet are pivotally coupled to adjacent corresponding flanges disposed along an upper surface of the base to pivotally attach the pallet to the base.

11. The carrier of claim 1, wherein the base comprises (i) a raised platform having a length that defines the longitudinal axis of the base, (ii) a first support structure extending along a first edge region of the raised platform and parallel to the longitudinal axis of the base, and (iii) a second support structure extending along a second edge region of the raised platform opposite the first edge region and parallel to the longitudinal axis of the base.

12. The carrier of claim 11, wherein a respective runner is disposed along a length of each of the first support structure and the second support structure.

13. The carrier of claim 1, wherein the carrier is positioned proximal to a receptacle so that, when the longitudinal axis of the metallurgical vessel is adjusted, material within the metallurgical vessel may fall to the receptacle.

14. A carrier for supporting a metallurgical vessel during a cleaning process of the metallurgical vessel, the carrier comprising:

a base comprising (i) a raised platform having a length that defines a longitudinal axis of the base, (ii) a first support structure extending along a first edge region of the raised platform and parallel to the longitudinal axis of the base, and (iii) a second support structure extending along a second edge region of the raised platform opposite the first edge region and parallel to the longitudinal axis of the base;

a pallet pivotally disposed on the base and pivotable between (i) a first position where a longitudinal axis along a length of the pallet is at a first angle relative to the longitudinal axis of the base, and (ii) a second position where the longitudinal axis of the pallet is at a second angle relative to the longitudinal axis of the base, the second angle greater than the first angle;

a tilting mechanism disposed on the carrier and operable to pivot the pallet between the first position and the second position responsive to a user input at a control of the tilting mechanism; and a cradle disposed at the pallet and configured to support the metallurgical vessel when the metallurgical vessel is positioned at the carrier for the cleaning process, whereby pivoting the pallet between the first position and the second position adjusts an angle of a longitudinal axis of the metallurgical vessel relative to the longitudinal axis of the base.

15. The carrier of claim 14, wherein the tilting mechanism comprises a hydraulic system disposed at the carrier.

16. The carrier of claim 14, wherein the control of the tilting mechanism is remote from the carrier and in wireless communication with the carrier for operation of the tilting mechanism.

17. The carrier of claim 14, wherein the longitudinal axis of the base is parallel to a ground surface at which the carrier is disposed.

18. The carrier of claim 14, wherein the longitudinal axis of the pallet is parallel to the longitudinal axis of the base when the pallet is in the first position.

19. A carrier for supporting a metallurgical vessel during a cleaning process of the metallurgical vessel, the carrier comprising:

a base comprising (i) a raised platform having a length that defines a longitudinal axis of the base, (ii) a first support structure extending along a first edge region of the raised platform and parallel to the longitudinal axis of the base, and (iii) a second support structure extending along a second edge region of the raised platform opposite the first edge region and parallel to the longitudinal axis of the base;

a pallet coupled to the base and pivotable between (i) a first position where a longitudinal axis along a length of the pallet is at a first angle relative to the longitudinal axis of the base, and (ii) a second position where the longitudinal axis of the pallet is at a second angle relative to the longitudinal axis of the base, the second angle greater than the first angle; and a cradle disposed on the pallet and configured to support the metallurgical vessel when the metallurgical vessel is positioned on the carrier for the cleaning process, whereby pivoting the pallet between the first position and the second position adjusts an angle of a longitudinal axis of the metallurgical vessel relative to the longitudinal axis of the base.

20. The carrier of claim 19, wherein a respective runner is disposed along a length of each of the first support structure and the second support structure.

* * * * *